US009741321B1

(12) United States Patent
Heuss et al.

(10) Patent No.: US 9,741,321 B1
(45) Date of Patent: Aug. 22, 2017

(54) ARRANGEMENTS, FEATURES, TECHNIQUES AND METHODS FOR SECURING STRINGS OF STRINGED INSTRUMENTS

(71) Applicant: Hankscraft, Inc., Reedsburg, WI (US)

(72) Inventors: David M. Heuss, Lake Mills, WI (US); Kelly G. Damaschke, Loganville, WI (US)

(73) Assignee: Hankscraft, Inc., Reedsburg, WI (US)

( * ) Notice: Subject to any disclaimer, the term of this patent is extended or adjusted under 35 U.S.C. 154(b) by 0 days.

(21) Appl. No.: 15/229,845

(22) Filed: Aug. 5, 2016

(51) Int. Cl.

| | |
|---|---|
| ***G10D 3/14*** | (2006.01) |
| ***G10D 3/12*** | (2006.01) |
| ***G10H 3/14*** | (2006.01) |
| ***G10D 1/08*** | (2006.01) |
| ***G10H 3/18*** | (2006.01) |
| ***G10G 3/00*** | (2006.01) |
| ***G10D 3/18*** | (2006.01) |
| ***G10D 3/00*** | (2006.01) |

(52) U.S. Cl.
CPC ..... *G10D 3/14* (2013.01); *G10D 1/085* (2013.01); *G10D 3/00* (2013.01); *G10D 3/12* (2013.01); *G10D 3/18* (2013.01); *G10G 3/00* (2013.01); *G10H 3/143* (2013.01); *G10H 3/18* (2013.01); *G10H 3/185* (2013.01); *G10H 3/186* (2013.01)

(58) Field of Classification Search
CPC .. G10D 3/00; G10D 3/12; G10D 3/14; G10D 3/18
USPC ..... 84/298, 299, 307
See application file for complete search history.

(56) References Cited

U.S. PATENT DOCUMENTS

| | | | | | |
|---|---|---|---|---|---|
| 572,677 | A | | 12/1896 | Goodwin | |
| 976,428 | A | | 11/1910 | Benson | |
| 1,476,712 | A | * | 12/1923 | Hafelfinger | G10D 3/14 84/302 |
| 1,657,890 | A | * | 1/1928 | Mertes | G10D 3/14 84/207 |
| 1,713,005 | A | * | 5/1929 | Rockwell | G10D 3/14 84/302 |
| 1,792,608 | A | * | 2/1931 | Schulenberg | G10D 3/14 84/302 |

(Continued)

FOREIGN PATENT DOCUMENTS

| | | |
|---|---|---|
| EP | 2135235 B1 | 11/2012 |
| KR | 1020110002945 | 1/2011 |
| WO | 0033290 A1 | 6/2000 |

OTHER PUBLICATIONS

Quick String Bridge Plate Protection Easy Installation—No Modifications Power Pins TM, BigRock Engineering Guitar Accessories, 2pgs., www.bigrockeng.com (2012-2013).

(Continued)

*Primary Examiner* — David Warren
(74) *Attorney, Agent, or Firm* — Merchant & Gould P.C.

(57) ABSTRACT

Apparatus and methods for securing a string to an acoustic, stringed instrument are disclosed. Example apparatus include string anchors secured to a bridge of the stringed instrument. The apparatus provide components enabling selective tensioning of the string. A seat arrangement provided by string anchors receives an anchor end of string and the string passes from the seat arrangement through a base arrangement and towards a headstock of the acoustic instrument.

20 Claims, 24 Drawing Sheets

(56) References Cited

U.S. PATENT DOCUMENTS

| | | | | | |
|---|---|---|---|---|---|
| 2,162,007 | A | * | 6/1939 | Gambino | G10D 3/14 84/302 |
| 2,232,458 | A | * | 2/1941 | Hubbard | G10D 3/14 84/302 |
| 2,234,218 | A | * | 3/1941 | Abrams | G10D 3/14 84/312 R |
| 2,241,284 | A | * | 5/1941 | Walder | G10D 3/14 84/266 |
| 2,304,597 | A | * | 12/1942 | Proelsdorfer | G10D 3/14 84/297 R |
| 2,322,137 | A | * | 6/1943 | Jauch | G10D 3/14 140/123.5 |
| 2,397,289 | A | * | 3/1946 | Proll | G10D 3/14 24/132 R |
| 2,416,593 | A | * | 2/1947 | Proll | G10D 3/14 24/133 |
| 4,004,485 | A | * | 1/1977 | Hiscott | G10D 3/14 84/207 |
| 4,106,387 | A | * | 8/1978 | Alifano | G10D 3/14 84/312 P |
| 4,197,779 | A | | 4/1980 | Holman | |
| 4,202,240 | A | | 5/1980 | Smith | |
| 4,366,740 | A | | 1/1983 | Tripp | |
| 4,426,907 | A | * | 1/1984 | Scholz | G10G 7/02 318/6 |
| 4,608,905 | A | | 9/1986 | Takabayashi | |
| 4,608,906 | A | | 9/1986 | Takabayashi | |
| 4,655,116 | A | * | 4/1987 | Matsui | G10D 3/14 84/297 R |
| 4,690,027 | A | * | 9/1987 | Ido | G10D 3/14 84/298 |
| 4,693,160 | A | * | 9/1987 | Hoshino | G10D 3/14 84/267 |
| 4,696,218 | A | | 9/1987 | Hoshino et al. | |
| 4,712,463 | A | * | 12/1987 | Kubicki | G10D 3/14 84/267 |
| 4,724,737 | A | | 2/1988 | Fender | |
| 4,807,508 | A | | 2/1989 | Yairi | |
| 4,811,645 | A | * | 3/1989 | Cummings | G10D 3/14 84/207 |
| 5,260,505 | A | | 11/1993 | Kendall | |
| 5,285,709 | A | * | 2/1994 | Grant | G10D 3/14 84/297 R |
| 5,477,764 | A | | 12/1995 | Carrico | |
| 5,542,330 | A | | 8/1996 | Borisoff | |
| 5,684,256 | A | * | 11/1997 | Rose | G10D 3/14 84/267 |
| 5,696,335 | A | * | 12/1997 | Rose | G10D 3/14 84/267 |
| 5,700,965 | A | * | 12/1997 | Rose | G10D 3/10 84/199 |
| 5,705,760 | A | * | 1/1998 | Rose | G10D 3/14 84/199 |
| 6,111,176 | A | | 8/2000 | Rose | |
| 6,143,967 | A | | 11/2000 | Smith et al. | |
| 6,184,450 | B1 | * | 2/2001 | LeBlanc | G10D 3/04 84/298 |
| 6,528,710 | B2 | * | 3/2003 | Steinberger | G10D 3/14 84/297 R |
| 6,818,814 | B2 | | 11/2004 | Park | |
| 7,112,733 | B1 | | 9/2006 | Babicz | |
| 7,183,475 | B2 | * | 2/2007 | Van Halen | G10D 3/14 84/297 R |
| 7,309,824 | B2 | * | 12/2007 | LeBlanc | G10D 3/14 84/298 |
| 7,351,895 | B1 | | 4/2008 | LeBlanc | |
| 7,394,005 | B1 | | 7/2008 | Anderson et al. | |
| 7,566,823 | B1 | | 7/2009 | Nikanen | |
| 7,592,528 | B2 | * | 9/2009 | Lyles | G10D 3/12 84/297 R |
| 7,847,170 | B1 | | 12/2010 | Anderson et al. | |
| D662,128 | S | | 6/2012 | Nuttall | |
| 8,294,011 | B2 | * | 10/2012 | Toone | G10D 3/14 84/313 |
| 9,190,032 | B2 | | 11/2015 | Heuss | |
| 9,196,232 | B2 | * | 11/2015 | Borisoff | G10D 3/14 |
| 9,218,795 | B1 | * | 12/2015 | Woolery | G10D 3/143 |
| 9,343,047 | B2 | | 5/2016 | Gray et al. | |
| 2002/0112591 | A1 | * | 8/2002 | Steinberger | G10D 3/14 84/312 R |
| 2003/0177883 | A1 | * | 9/2003 | Rose | G10D 3/04 84/298 |
| 2004/0159203 | A1 | * | 8/2004 | Van Halen | G10D 3/14 84/297 R |
| 2007/0095194 | A1 | * | 5/2007 | Moerth | G10C 9/00 84/452 R |
| 2007/0214932 | A1 | | 9/2007 | Stalans | |
| 2010/0000392 | A1 | | 1/2010 | Uberbacher | |
| 2010/0175534 | A1 | * | 7/2010 | McCabe | G10D 3/14 84/313 |
| 2011/0011238 | A1 | * | 1/2011 | Toone | G10D 3/14 84/297 S |
| 2012/0318117 | A1 | | 12/2012 | Deck | |
| 2013/0139670 | A1 | * | 6/2013 | Goto | G10D 3/14 84/312 R |
| 2015/0310838 | A1 | * | 10/2015 | Borisoff | G10D 3/14 84/299 |

OTHER PUBLICATIONS

Acoustic Nation, Product Spotlight: Power Pins, Guitar World, NewBay Media, LLC (NY), www.guitarworld.com, 5pgs. (2013).

PCT/ISA/220, Notification of Transmittal of International Search Report and the Written Opinion of the International Searching Authority, or the Declaration, 13pgs., WO201511649A1, May 8, 2015.

U.S. Appl. No. 15/240,433, filed Aug. 18, 2016, 38pgs.

* cited by examiner

ARRANGEMENTS, FEATURES, TECHNIQUES AND METHODS FOR SECURING STRINGS OF STRINGED INSTRUMENTS

FIELD OF THE DISCLOSURE

The present disclosure relates to arrangements, features, techniques and methods for securing strings of a stringed instrument, such as an acoustic guitar. The methods and apparatus can also be used for tuning the strings of acoustic guitars, if desired.

BACKGROUND

Stringed acoustic instruments typically include a pin-in-hole configuration for securing a ball end of the string to a bridge. An example stringed acoustic instrument, a guitar 2, is shown in FIG. 1A. FIG. 1B is a schematic diagram of the pin-in-hole securing design shown in FIG. 1A.

As shown in FIG. 1B, a non-ball end of the string 10 is fed up through a bridge hole until the ball end 14 of the string comes in contact with the underside of the bridge 12. A pin 16 is then inserted into the bridge hole and forms an interference fit with the hole, keeping the string 10 in place. The opposite end of the string, the non-ball end, is then fed over the saddle 18 and secured to a headstock of the instrument. String tension is adjusted using a key on the headstock of the guitar.

The sizes of the holes in stringed acoustic instruments are non-uniform. Additionally, different shapes and sizes of pins are used to form an interference fit with the hole and secure the ball end of the string. In a typical acoustic stringed instrument, string tension can only be adjusted using the keys.

SUMMARY

Techniques and apparatus disclosed herein relate to securing strings of stringed instruments. In addition, techniques and apparatus disclosed herein relate to selectively adjusting string tension.

In general, apparatus for securing strings of stringed instruments include a base arrangement, a string anchor seat assembly, and an actuator arrangement. The base arrangement secures to stringed instruments, typically at a bridge. A string anchor seat assembly pivotally mounts to a base arrangement. A seat arrangement provided by string anchor seat assembly receives an anchor end of string. The base assembly defines a string channel through which string passes from the seat arrangement to a saddle positioned on the bridge.

Tension adjustment of a string is provided by adjusting an actuator arrangement that is in communication with the string anchor seat assembly. In use, as the actuator arrangement is operated, the string anchor seat assembly pivots thereby adjusting string tension.

Methods and techniques disclosed include securing a string to a stringed instrument. These methods and techniques include positioning an anchor end of string in an anchor assembly. Then the non-anchor end of the string is secured at a headstock of the stringed instrument. Thereafter, string tension can be adjusted using components of the anchor assembly.

The details of one or more embodiments are set forth in the accompanying drawings and the description below. Other features, objects, and advantages of these embodiments will be apparent from the description, drawings, and claims. Moreover, it is to be understood that both the foregoing summary of the disclosure and the following detailed description are exemplary and intended to provide further explanation without limiting the scope of the disclosure.

BRIEF DESCRIPTION OF THE DRAWINGS

The following figures, which form a part of this application, are illustrative of described technology and are not meant to limit the scope of the claims in any manner.

DETAILED DESCRIPTION

Figure 1A:
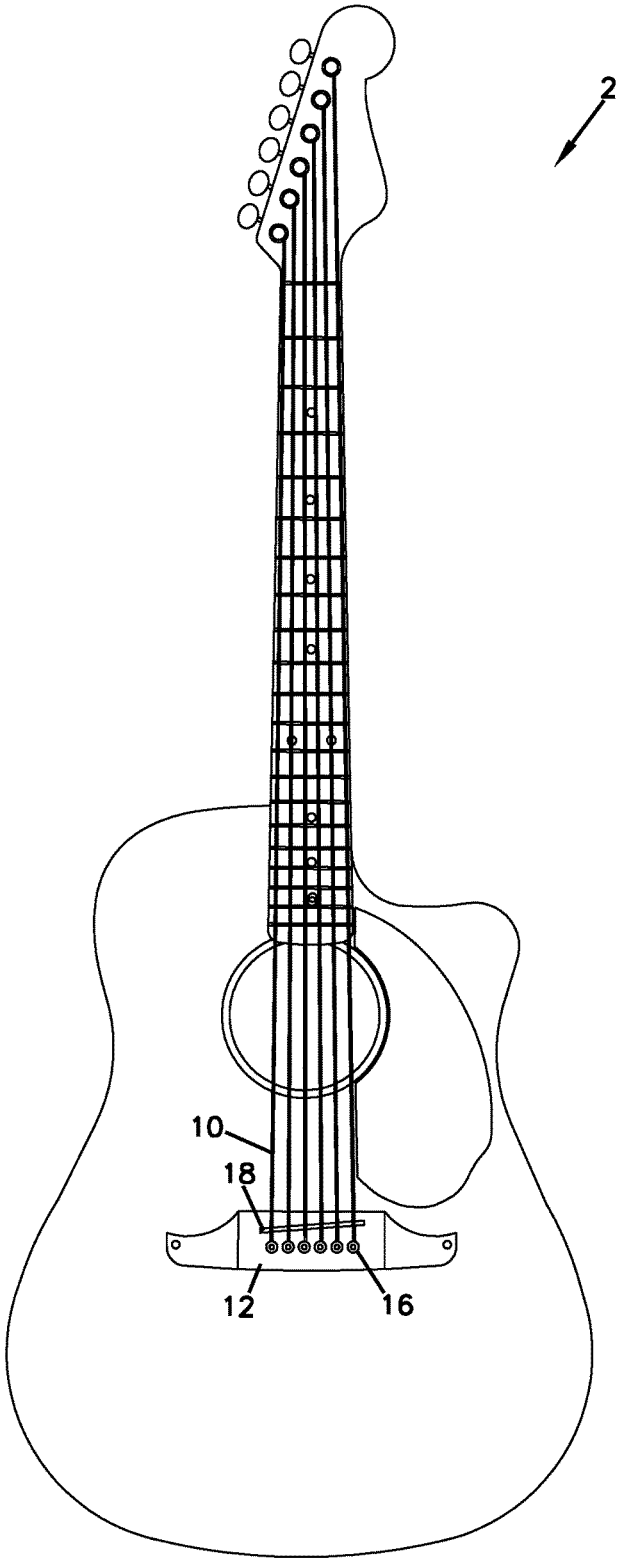
FIG. 1A (PRIOR ART)
FIG. 1A is an illustration of a prior art stringed instrument.
Figure 1B:
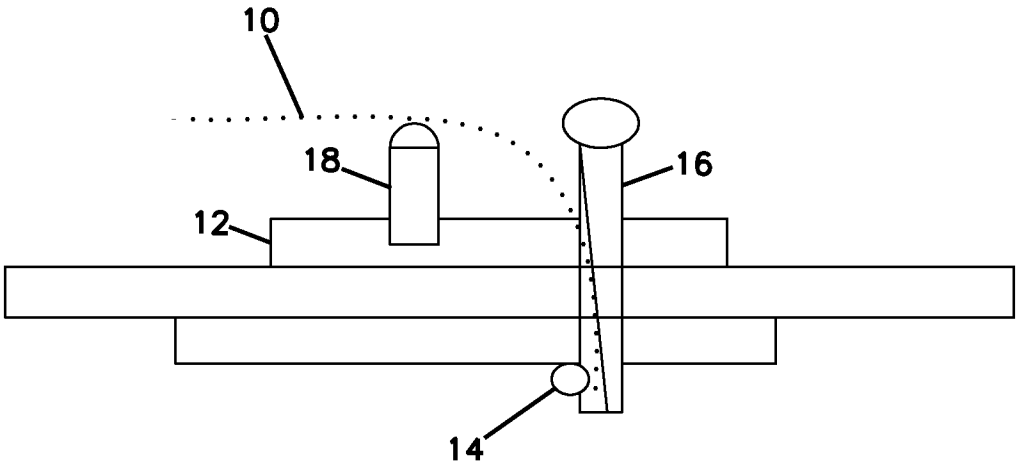
FIG. 1B (PRIOR ART)
FIG. 1B is a schematic diagram of a pin-in-hole securing design in the stringed instrument of FIG. 1A.

Various embodiments of the present invention will be described in detail with reference to the drawings, wherein like reference numerals represent like parts and assemblies throughout the several views. The features described herein are examples of implementations of certain broad, inventive aspects which underlie the disclosure.

As briefly described above, embodiments of the present invention are directed to securing a string to a stringed instrument. Existing securing devices, such as the pin-in-hole configuration discussed above, provide string tension adjustment capability in only one location: at the headstock. String anchors contemplated by the instant disclosure advantageously provide tuning capabilities at the bridge. When a capo is used on a fretboard of a stringed instrument, the strings cannot be tuned using the tuners at the headstock. By providing tuning capability at the bridge, the strings can be tuned when a capo is placed on the fretboard.

Additionally, providing tuning capabilities at the bridge can be convenient depending upon the circumstances, for example, when tuning. Rather than reaching across the body with the dominant hand to modify the tuning at the headstock, the person tuning the instrument can use the dominant hand near where it normally is—close to the bridge. Additionally, if the non-dominant hand is being used to play a note for tuning purposes, that hand can stay in position rather than being used to adjust the tuning key at the headstock. Generally, the arrangements, features, techniques and methods contemplated below are directed to avoid the issues mentioned above with existing securing devices and provide additional functionality at the string anchor.

Figure 2:
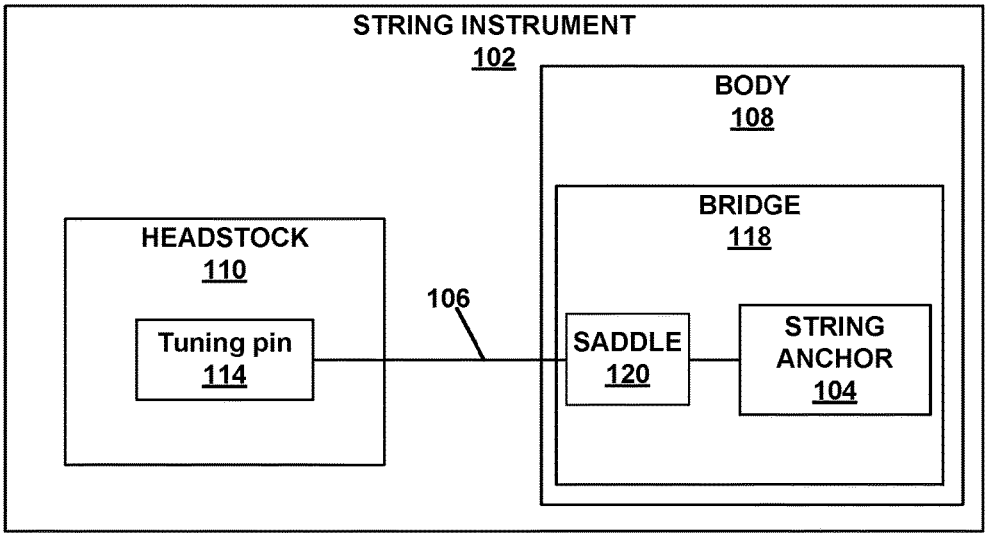
FIG. 2 is a schematic diagram of an example stringed instrument.

FIG. 2 is a schematic block diagram of an example string instrument 102. String instrument 102 includes body 108 having bridge 118 that includes string anchor 104 and saddle 120. Opposite body 108 is headstock 110 including tuning pin 114. String 106 is secured on one end by string anchor 104, passes over saddle 120, and is secured on the opposite end by tuning pin 114. Example string instrument 102 is typically an acoustic instrument.

Typically, string instrument 102 is a hand-held acoustic instrument. In some instances, string instrument 102 is an acoustic guitar. In those instances, the acoustic guitar typically includes six strings and usual components such as a neck connecting the body and the headstock, frets, sound hole, and bridge holes. String anchor 104 can also be used with acoustic guitars having more or fewer than six strings. In other instances, string instrument 102 can be other hand-held acoustic instruments, such as any one of: viola, violin, sitar, ukulele, mandolin, or lute.

Tuning pin 114 is any tuning pin known in the art. Guitar string 106 can be made of a single material, such as, for example, steel, nylon, gut, or brass. Alternatively, guitar string 106 can be a wound string comprising a core and overwinding. Guitar string 106 has an anchor end, hereinafter referred to as the "ball end" of string 106. The ball end can be any polyhedra known in the art, such as, cylinder, sphere, hemisphere, prism, pyramid, and variations or combinations of polyhedra.

Typically, string anchor 104 is retrofitted onto existing string instruments 102. As an alternative, string anchor 104 is used in the construction of a new string instrument 102. Examples of string anchor 104 are shown and described in more detail below with reference to FIGS. 3A-7E.

Figure 3A:
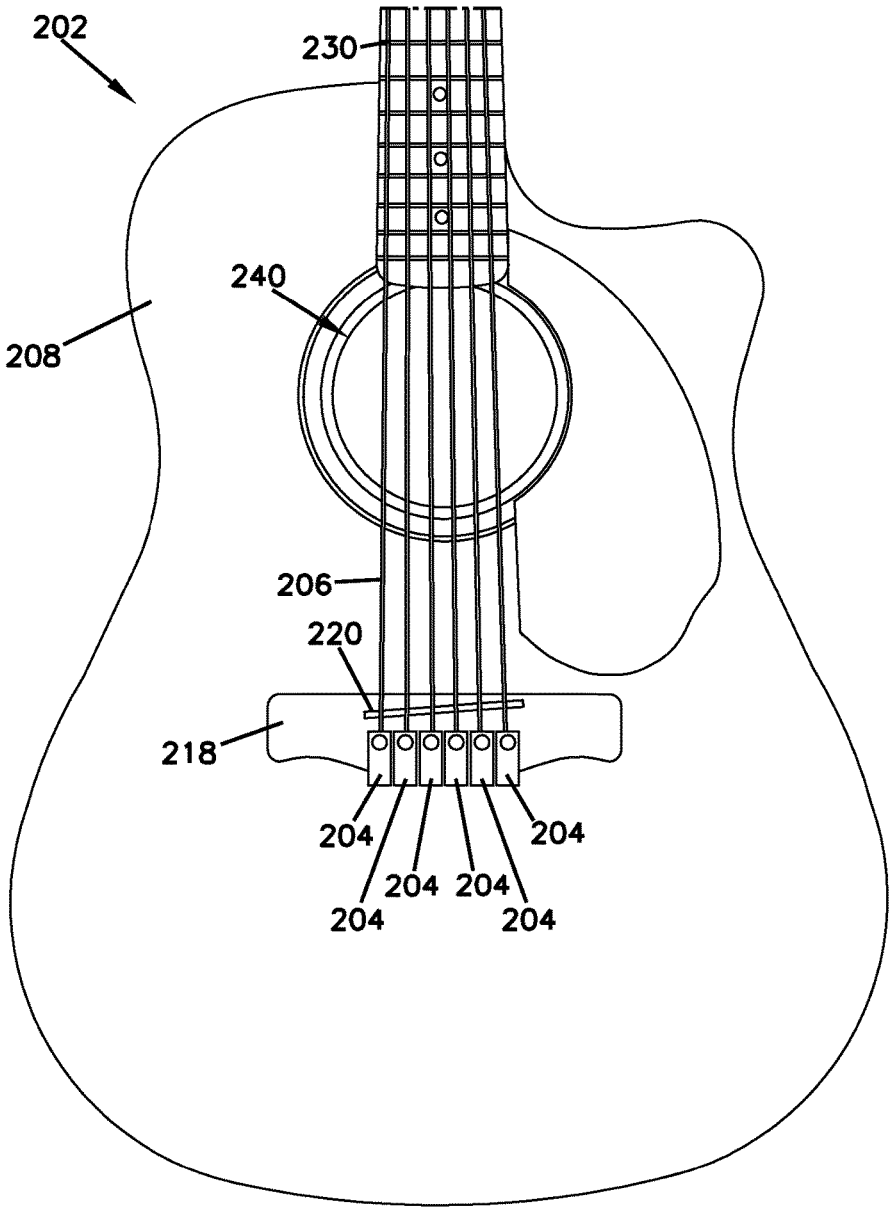
FIG. 3A is an illustration of a stringed instrument including example string anchors.
Figure 3B:
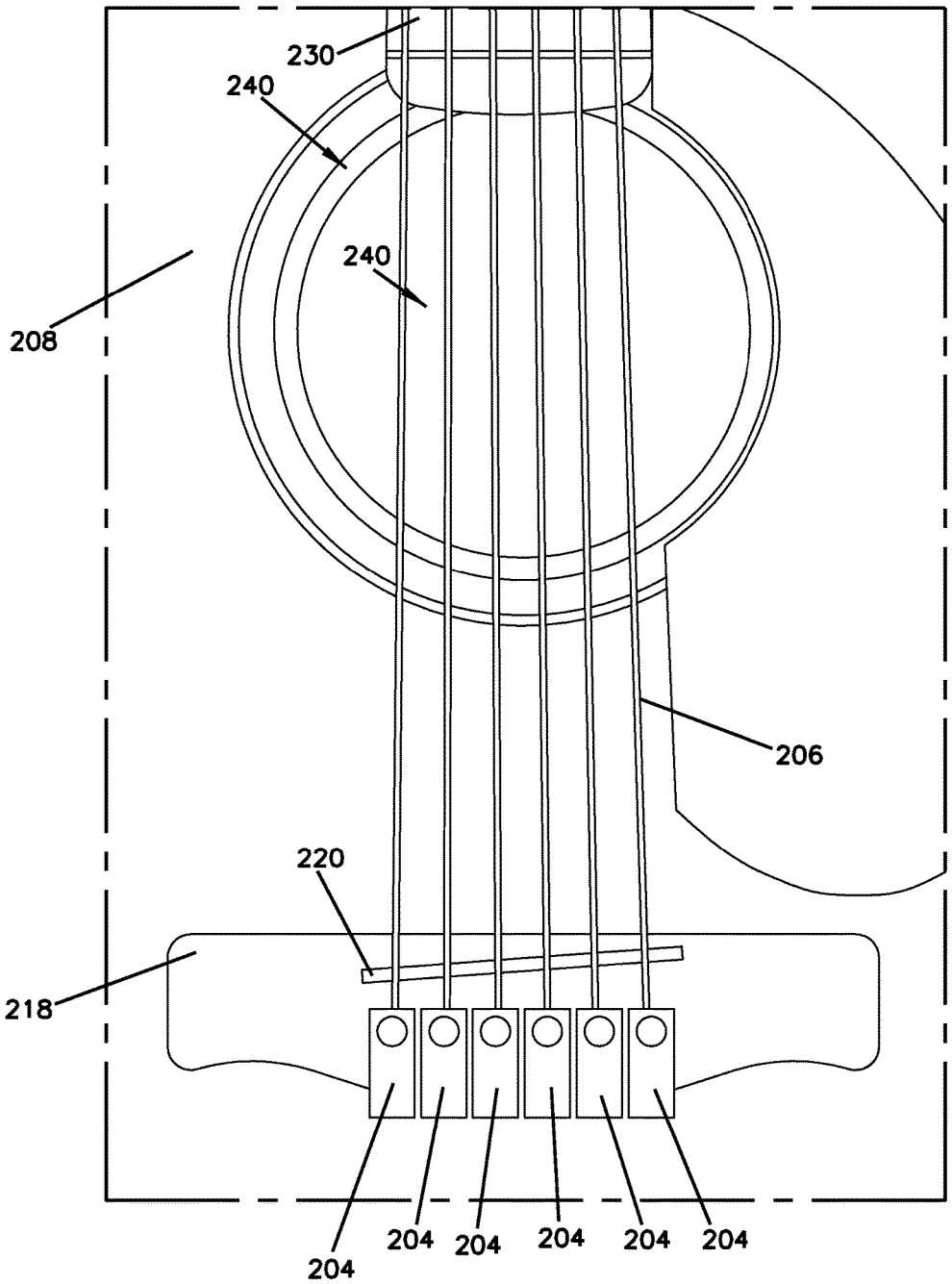
FIG. 3B is a view of a portion of FIG. 3A.
Figure 3C:
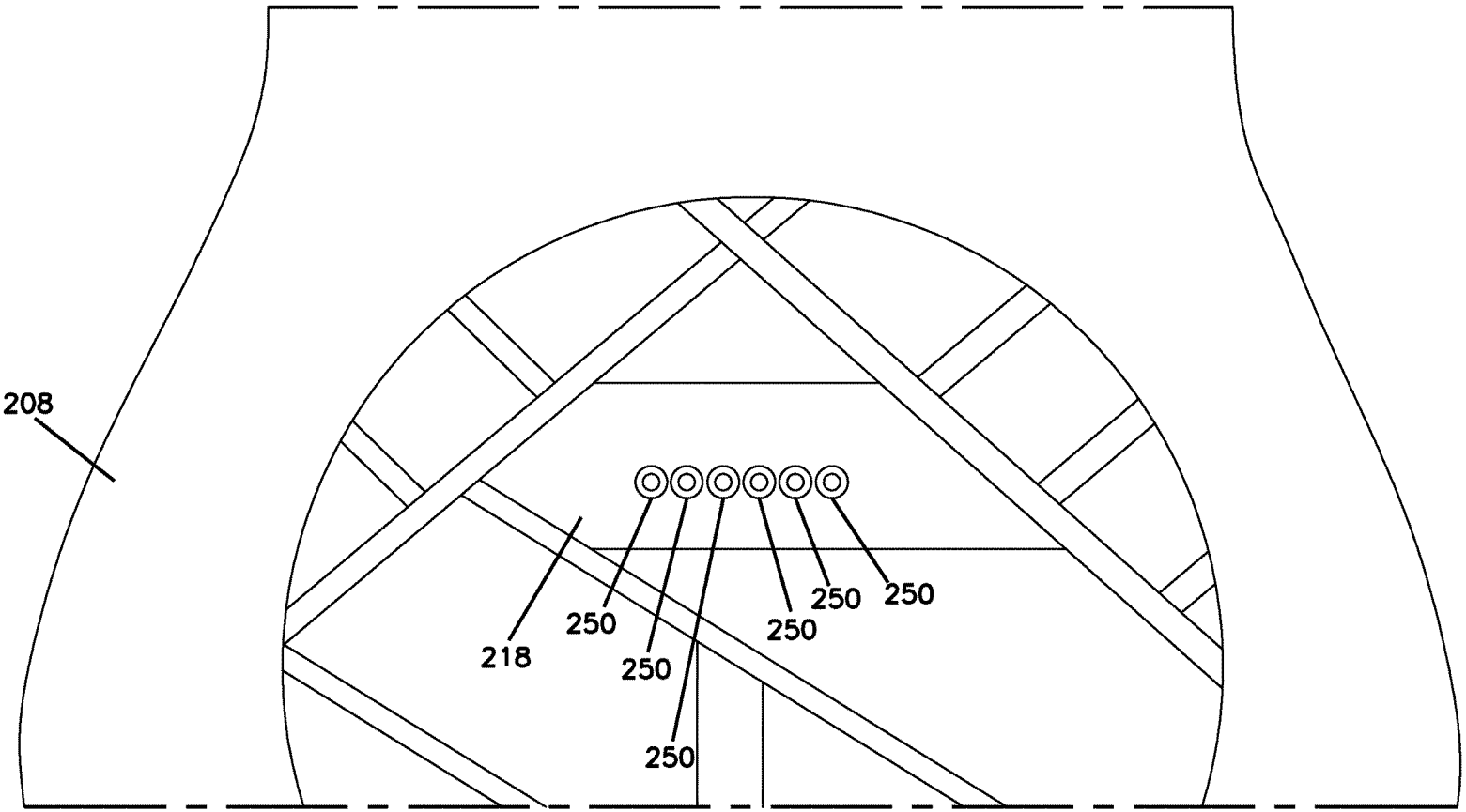
FIG. 3C is a rear view of the stringed instrument of FIG. 3A with a portion of the instrument removed.

FIG. 3A is a front view a portion of an acoustic guitar 202 with string anchors 204. FIG. 3B shows a portion of acoustic guitar 202 in FIG. 3A. FIG. 3C is a portion of a rear view of acoustic guitar 202 in FIG. 3A, with part of the guitar body removed. Unless otherwise noted, each is discussed concurrently below.

String anchors 204 are positioned on bridge 218, which is secured to body 208. Six strings 206 are secured on one end by string anchors 204 and pass over saddle 220. Strings 206 are secured on the opposite end at the headstock, not shown.

As shown, string anchors 204 are sized such that when installed onto bridge 218 a marginal space exists between adjacent sides of string anchors 204. As the reader will appreciate, manufacturing variations in the spacing between bridge pin holes may cause some string anchors 204 to be closer to adjacent string anchors 204 when installed.

When string anchor 204 is installed, a length of string anchor 204 is oriented along the direction of strings 206. A general scale of the size of string anchor 204 is evident from FIGS. 3A and 3B. Specific dimensions are provided below with reference to FIGS. 4A-4F.

FIGS. 3A and 3B also depict neck 230 connected to body 208 and sound hole 240 defined by body 208.

A portion of guitar body 208 is removed in FIG. 3C. FIG. 3C shows an underside of bridge 218 with nut 250 securing each string anchor 204 thereto.

Figure 4A:
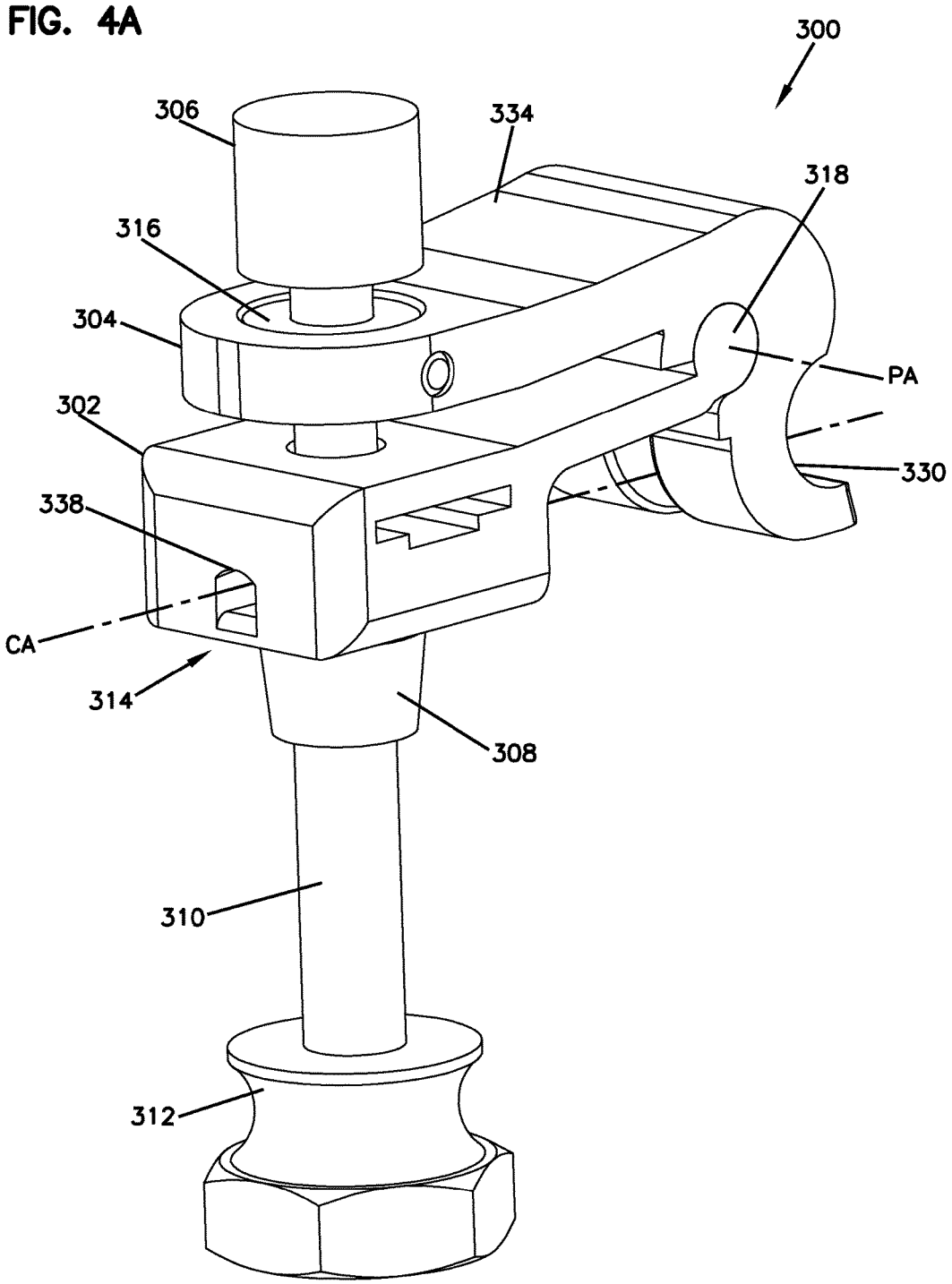
FIG. 4A is a front perspective view of a string anchor.

FIG. 4A is a front perspective view of string anchor 300. String anchor 300 mounts to a stringed instrument, not shown, and retains an anchor end of string. String anchor 300 also is configured to adjust the tension of string, thereby altering the sound of the string.

Figure 4B:
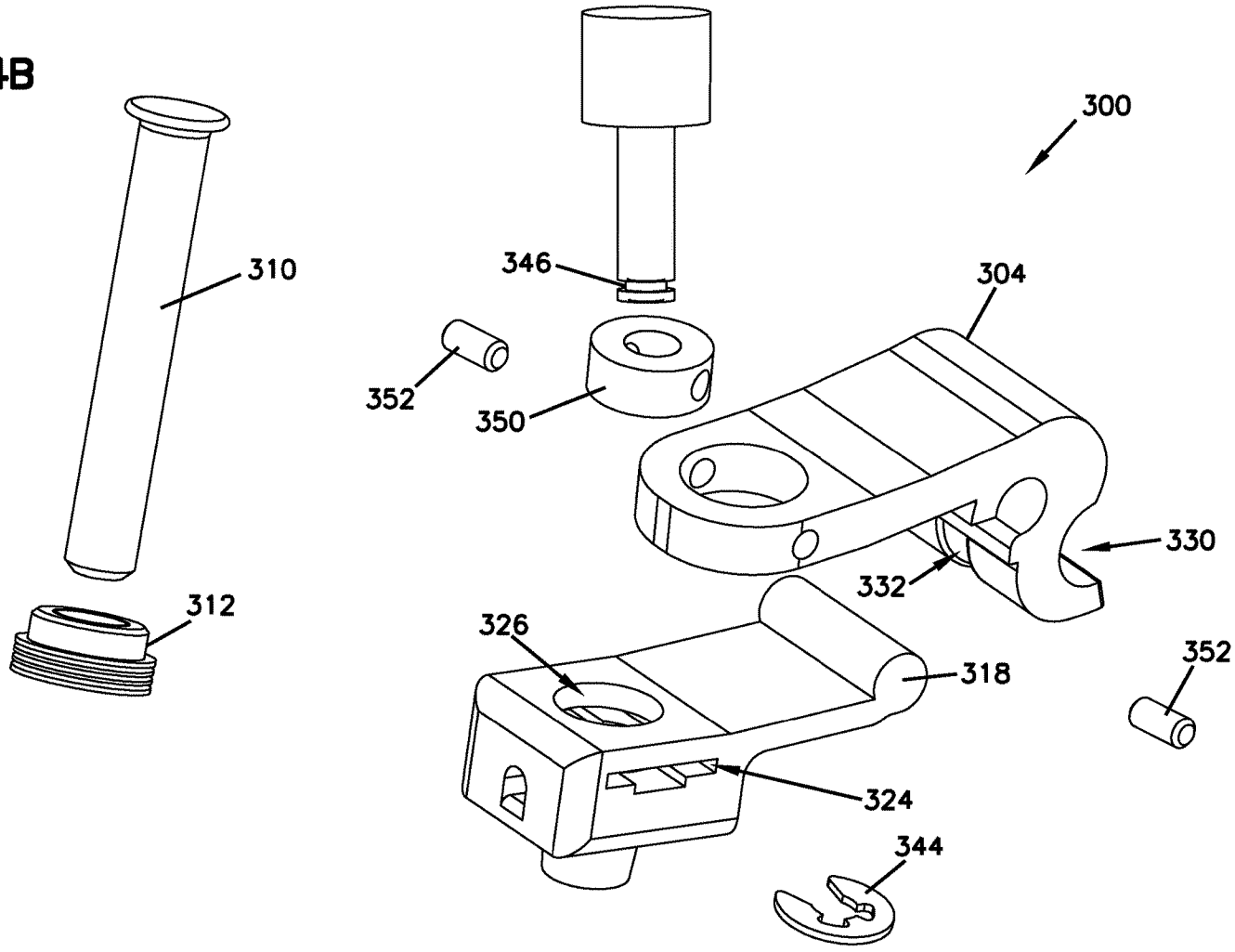
FIG. 4B is an exploded view of the string anchor of FIG. 4A.
Figure 4C:
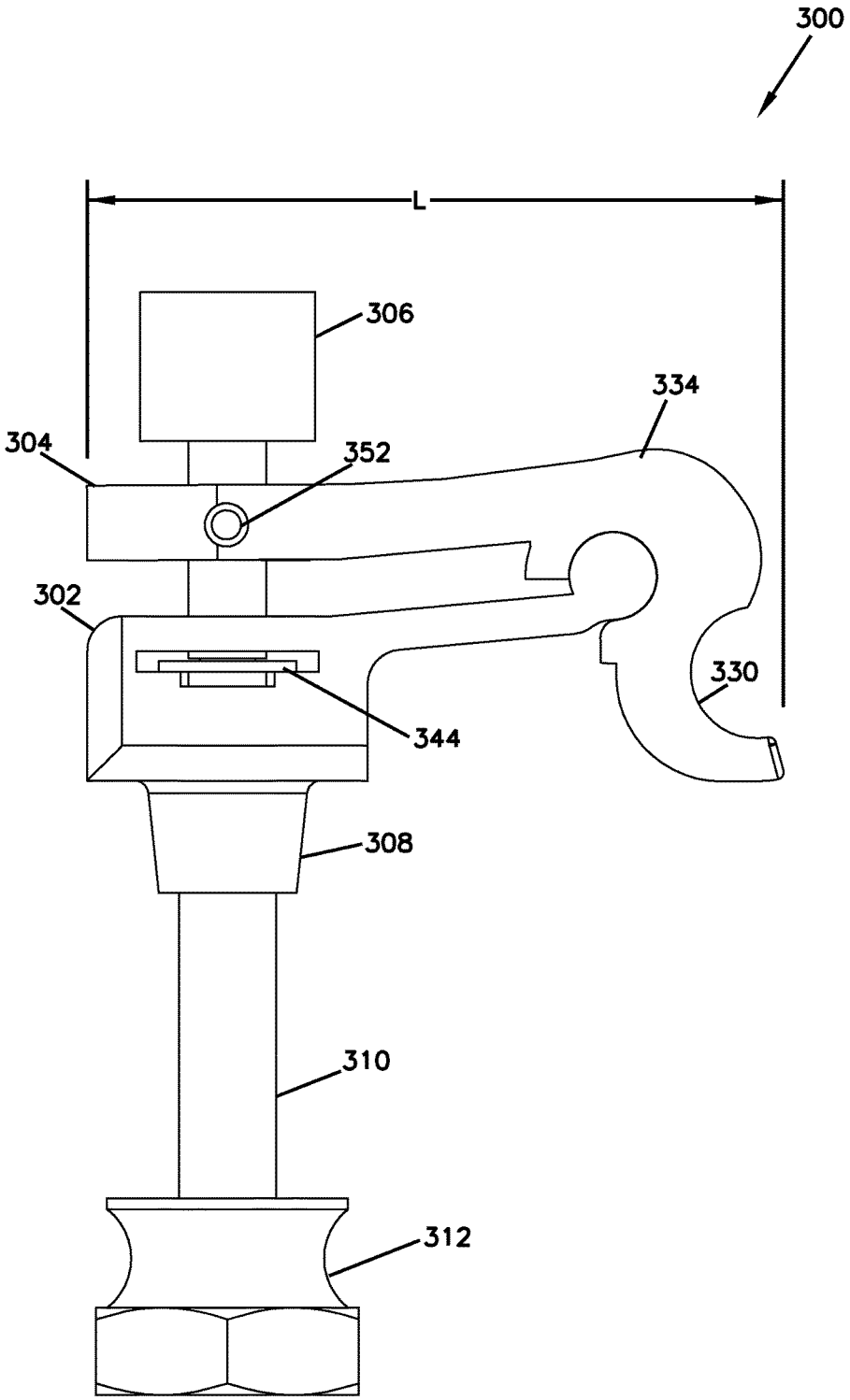
FIG. 4C is a right side plan view of the string anchor of FIG. 4A.
Figure 4D:
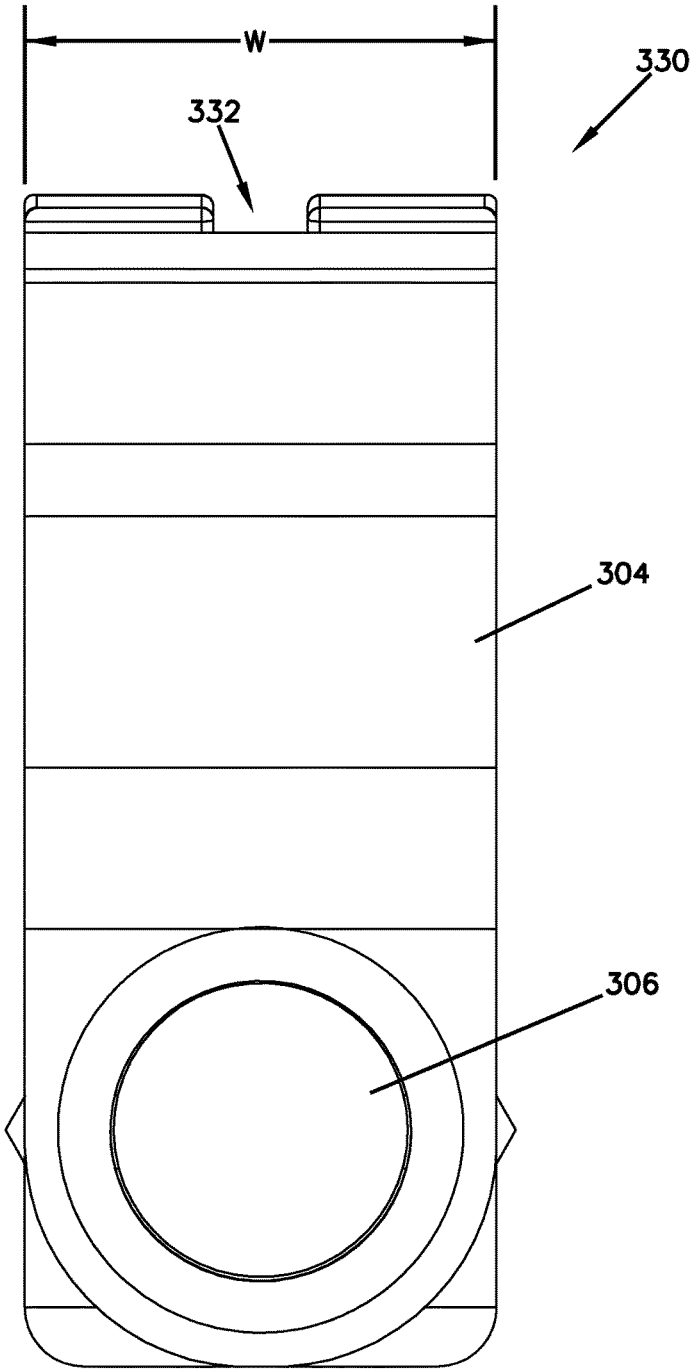
FIG. 4D is a top plan view of the string anchor of FIG. 4A.
Figure 4E:
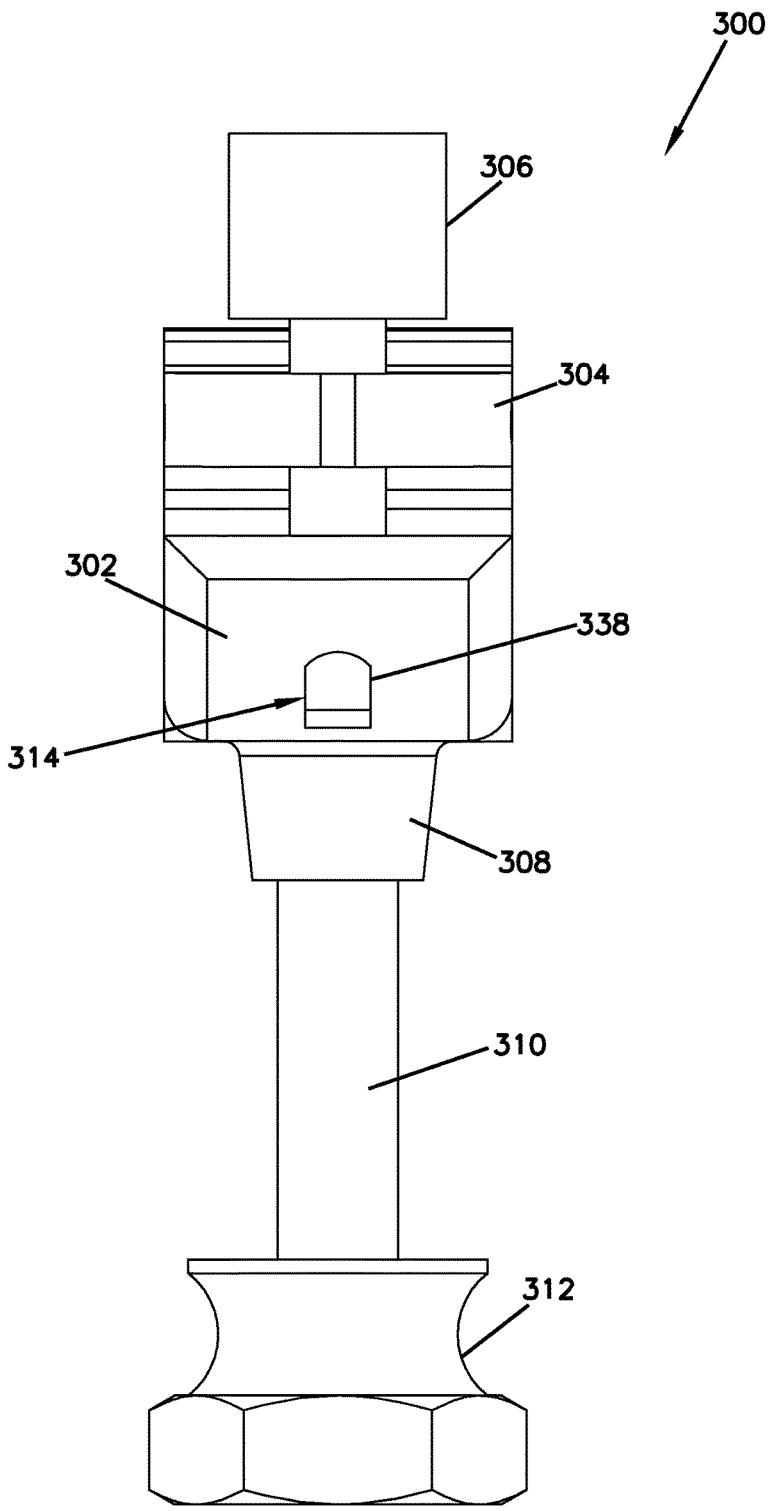
FIG. 4E is a front plan view of the string anchor of FIG. 4A.
Figure 4F:
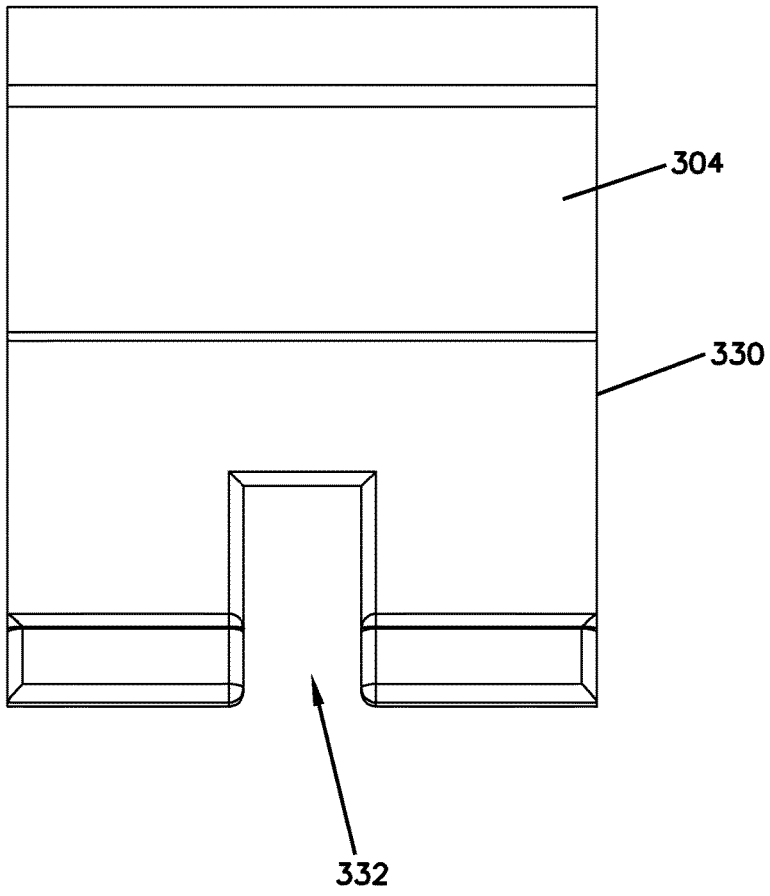
FIG. 4F is a rear plan view of a portion of the string anchor of FIG. 4A.

FIGS. 4A-4F illustrate example string anchor 300 and are discussed concurrently below, unless otherwise noted. FIG. 4B is an exploded view of string anchor 300. FIG. 4C is a side plan view of string anchor 300. FIG. 4D is a top plan view of string anchor 300. FIG. 4E is a front plan view of string anchor 300. FIG. 4F is a rear plan view of string anchor seat arrangement 304, only.

String anchor 300 includes base arrangement 302, string anchor seat arrangement 304 and actuator arrangement 306. String anchor seat arrangement 304 is pivotally mounted on base arrangement 302. Actuator arrangement 306 is coupled to base arrangement 302.

Base arrangement 302 couples to the stringed instrument and provides mount 318 for string anchor seat arrangement 304. Mount 318 defines pivot axis PA. As shown, mount 318 is cylindrical but other shapes are contemplated. Mount 318 is positioned at or near an end of base arrangement 302 opposite the end with string channel exit 338.

Pivot axis PA is oriented such that movement of string anchor seat arrangement 304 about pivot axis PA either increases or decreases tension of the string. This orientation of pivot axis PA is generally orthogonal to a length of the stringed instrument's headstock.

Base arrangement 302 also includes string instrument mount 308 that mounts the base arrangement 302 to the stringed instrument when positioned for use. String instrument mount 308 passes into a string hole or aperture of the stringed instrument. Preferably, string instrument mount 308 is a truncated cone to enable a fit in varying string hole sizes. Alternatively, string instrument mount 308 is cylindrical. Still other shapes of string instrument mount 308 are possible.

As shown, string instrument mount 308 receives securing peg 310. That is, string instrument mount 308 defines an inner cavity sized to receive securing peg 310. Preferably, at least a portion of securing peg 310 and inner cavity are threaded, thereby enabling their coupling. An adhesive can be used to couple securing peg 310 and string instrument mount 308, instead of or in addition to threaded coupling. Alternatively, string instrument mount 308 and securing peg 310 are continuous.

Base arrangement 302 defines string channel 314. String channel 314 provides a channel through base arrangement 302 for guitar string to pass between anchor seat arrangement 304 and the headstock of the stringed instrument. String channel 314 has string channel axis CA generally parallel to a length of the stringed instrument's headstock.

Base arrangement 302 also defines actuator arrangement receiving cavity 322. Actuator arrangement receiving cavity 322 receives components of actuator arrangement 306. Actuator arrangement receiving cavity 322 has top window 324 and side windows 326. Optionally, side windows 326 are sealed off after positioning actuator arrangement 306 within actuator arrangement receiving cavity 322.

Figure 5A:
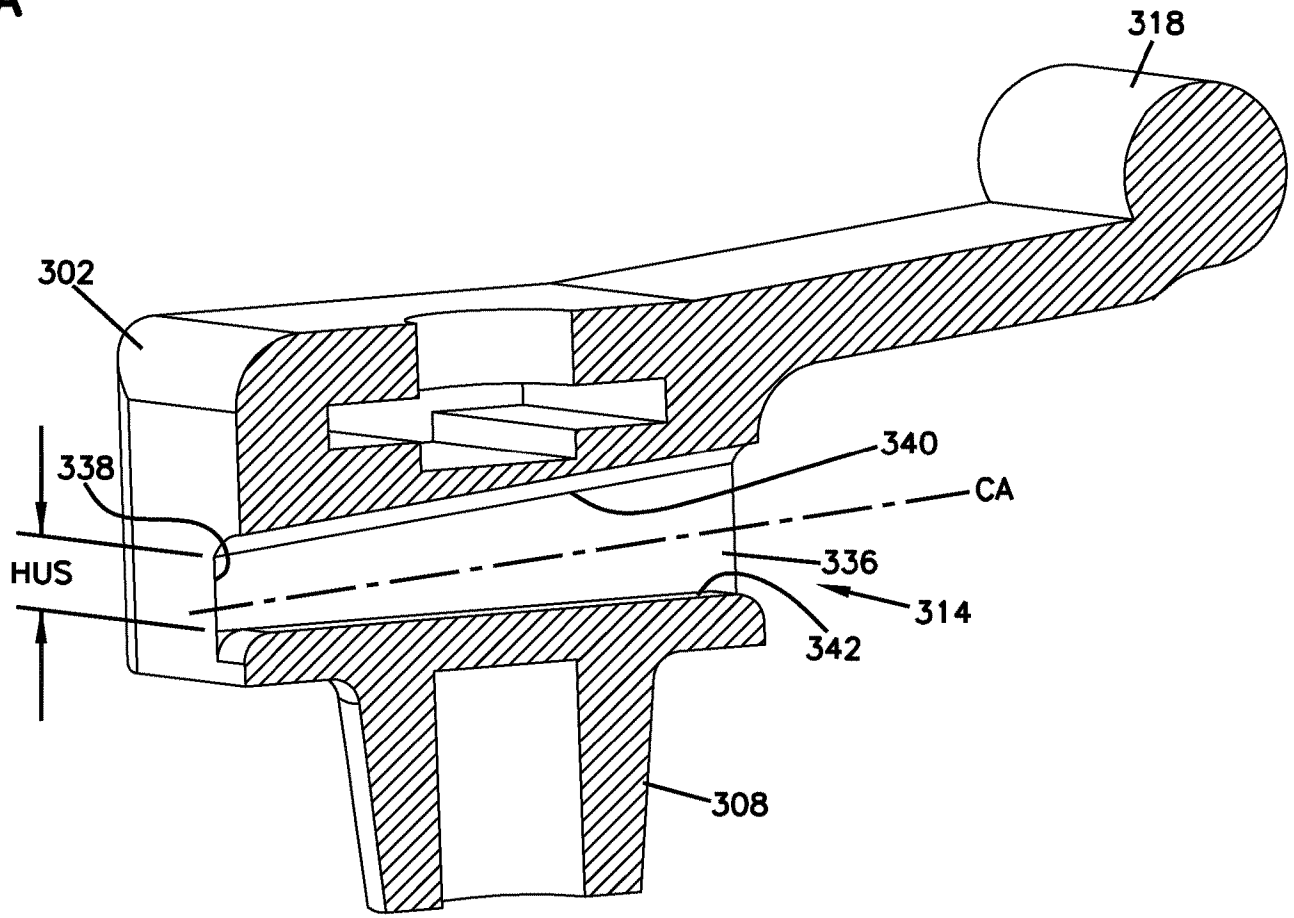
FIG. 5A is a right side sectional view of a portion of the string anchor of FIG. 4A.
Figure 5B:
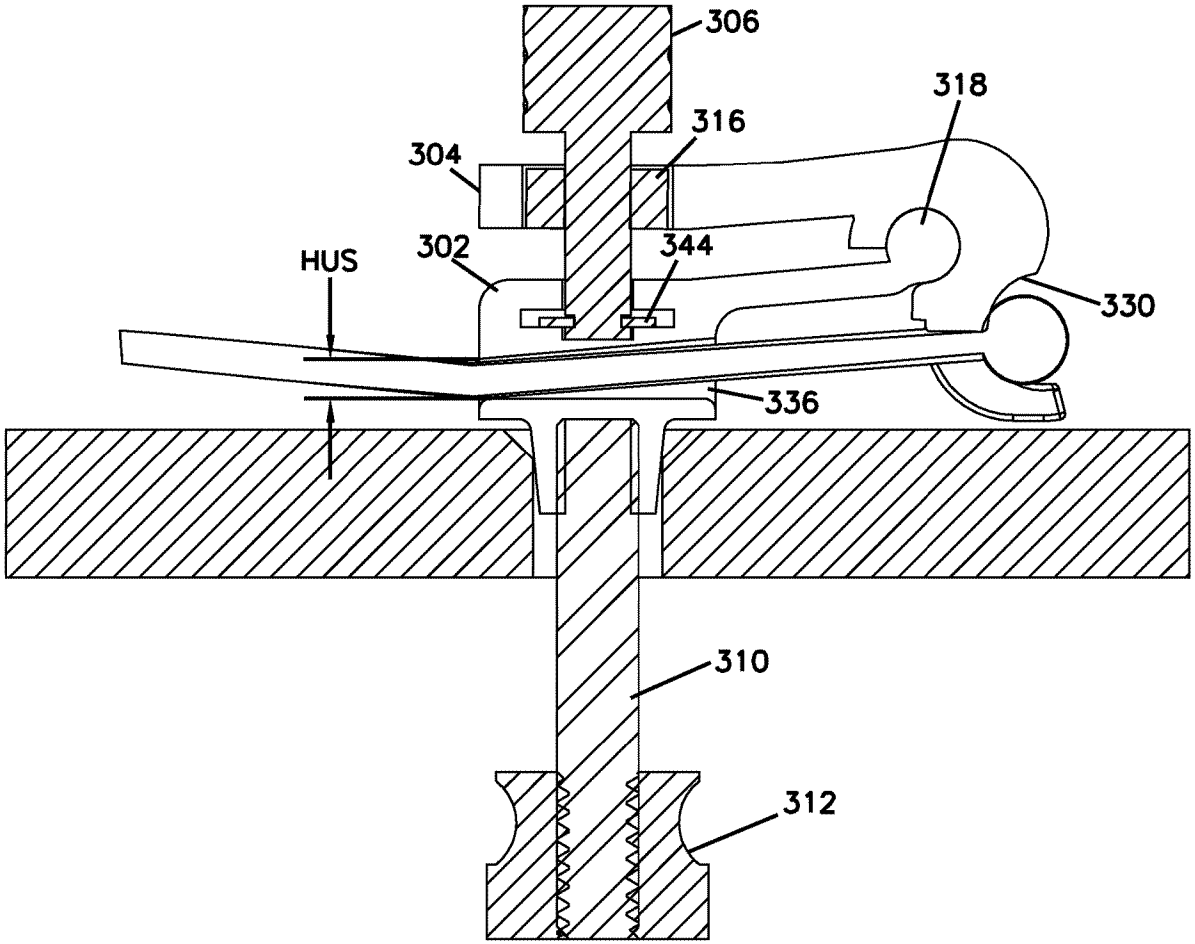
FIG. 5B is a right side sectional view of the string anchor of FIG. 4A including a string and mounted to a bridge.

Referring to FIGS. 5A and 5B, string channel 314 includes string channel entry 336 and string channel exit 338 opposite string channel entry 336. Upper surface 340 extends from string channel entry 336 to string channel exit 338.

Preferably, upper surface 340 slopes downward from string channel entry 336 to string channel exit 338. That is, when string anchor 300 is mounted to stringed instrument, upper surface 340 slopes downward toward the body and the headstock. As shown, lower surface 342 is planar and not sloping—it is oblique to upper surface 340. Preferably, a cross sectional area of string channel entry 336 is larger than a cross sectional area of string channel exit 338. Alternatively, both lower 342 and upper 340 surfaces are parallel and the cross sectional area of string channel entry 336 and string channel exit 338 are equal.

Preferably, upper surface 340 slopes downward at an angle between 4-8°. In some instances, upper surface 340 slopes downward at an angle of 5°.

Referring again to FIGS. 4A-4F, preferably, upper surface 340 has a curved cross-section. The curved upper surface 340 can be seen, at least, in FIGS. 4A, 4B, and 4E. The curved upper surface 340 facilitates receiving string, which also has a circular cross-section. As compared to a planar upper surface configuration, curved upper surface 340 limits lateral movement of string. However, a planar upper surface 340 is contemplated in some instances.

At string channel exit 338, upper surface 340 is lower than a saddle of stringed instrument. For sound and playability, it is important that string contact the saddle. To account for saddle heights that vary across manufacturer and stringed instrument type, height HUS of string channel exit 338 of upper surface 340 is preferably less than 0.09 inch. In some instances, height HUS of string channel exit 338 is 0.07 inch.

String anchor seat arrangement 304 provides recess for anchor end of string and causes tension adjustment of string. String anchor seat arrangement 304 includes tensioning arm 334 including a string anchor seat 330 and notch 332 through which string passes.

Seat 330 is a recess against which anchor end of string abuts. Preferably, seat 330 has an arced cross-sectional surface which limits potential movement of anchor end. Optionally, seat 330 has a v-shaped cross section. Other configurations of seat 330 are contemplated.

As shown in FIG. 5B, when string anchor 300 is installed on string instrument, curved surface of notch 332 is oriented opposite from the headstock. In this way, the ball end of string rests against curved surface of notch 332 and string passes through string channel 314 towards the headstock.

Notch 332 is defined by tensioning arm 334 and seat 330. Notch 332 is aligned with string channel axis CA. In this alignment, string passes from seat 330 to string channel entry 336, through string channel 314, and out string channel exit 338. Preferably, notch 332 is defined on three sides, as seen in FIG. 4F. Alternatively, notch 332 is a channel and defined on every side.

Actuator arrangement 306 is the interface enabling a user to adjust string tension. Preferably, rotation of actuator arrangement 306 causes string anchor seat arrangement 304 to pivot about pivot axis PA, either increasing or decreasing string tension.

Actuator arrangement 306 does not move vertically (either up or down along the rotational axis) as actuator arrangement 306 rotates. Movement of actuator arrangement 306 is discussed in greater detail with reference to FIGS. 6A-6C, below.

Retaining clip 344 enables actuator arrangement 306 to rotate in either direction and prevents actuator arrangement 306 from disconnecting from string anchor 300. Actuator arrangement 306 includes recessed notch 346 near one end. Retaining clip 344 connects to actuator arrangement 306 at recessed notch 346 within actuator arrangement receiving cavity 322.

Link arrangement 316 translates rotation of actuator arrangement 306 to pivoting of string anchor seat arrangement 304. Link arrangement 316 is connected to string anchor seat arrangement 304 and in communication with actuator arrangement 306.

As seen most clearly in FIG. 4B, link arrangement 316 includes pivot nut 350 and dowel pin 352. Pivot nut 350 is mounted on an aperture through the tensioning arm 334. Pivot nut 350 has an annular cross section. The inner radial surface of pivot nut 350 is threaded to engage the threaded actuator arrangement 306. The outer radial surface of pivot nut 350 can be smooth. Dowel pin 352 secures pivot nut 350 to tensioning arm 334.

Preferably, the length L of string anchor 300 is less than 1.5 inches. Length L is shown in FIG. 4C as the distance from the front to the rear of string anchor 300. In some instances, the length L of string anchor 300 is 1 inch. Optionally, string anchor 300 has a length L less than 1 inch, such as 0.9 inch or 0.8 inch. Other lengths L are contemplated.

Preferably, the width W of string anchor 300 is equal to or less than 0.5 inch. Width W is shown in FIG. 4D. In some instances, width W is 7/16 inch. Optionally, width W of string anchor 300 is 3/8 inch. Other widths W are contemplated.

Components of string anchor 300, such as base arrangement 302 and string anchor seat arrangement 304 are preferably metal material. For instance, string anchor 300 and base arrangement 302 are aluminum. Other materials contemplated for components of string anchor 300 include steel, stainless steel, chrome-plated aluminum, brass, iron, zinc, plastic, and composite material.

Figure 6A:
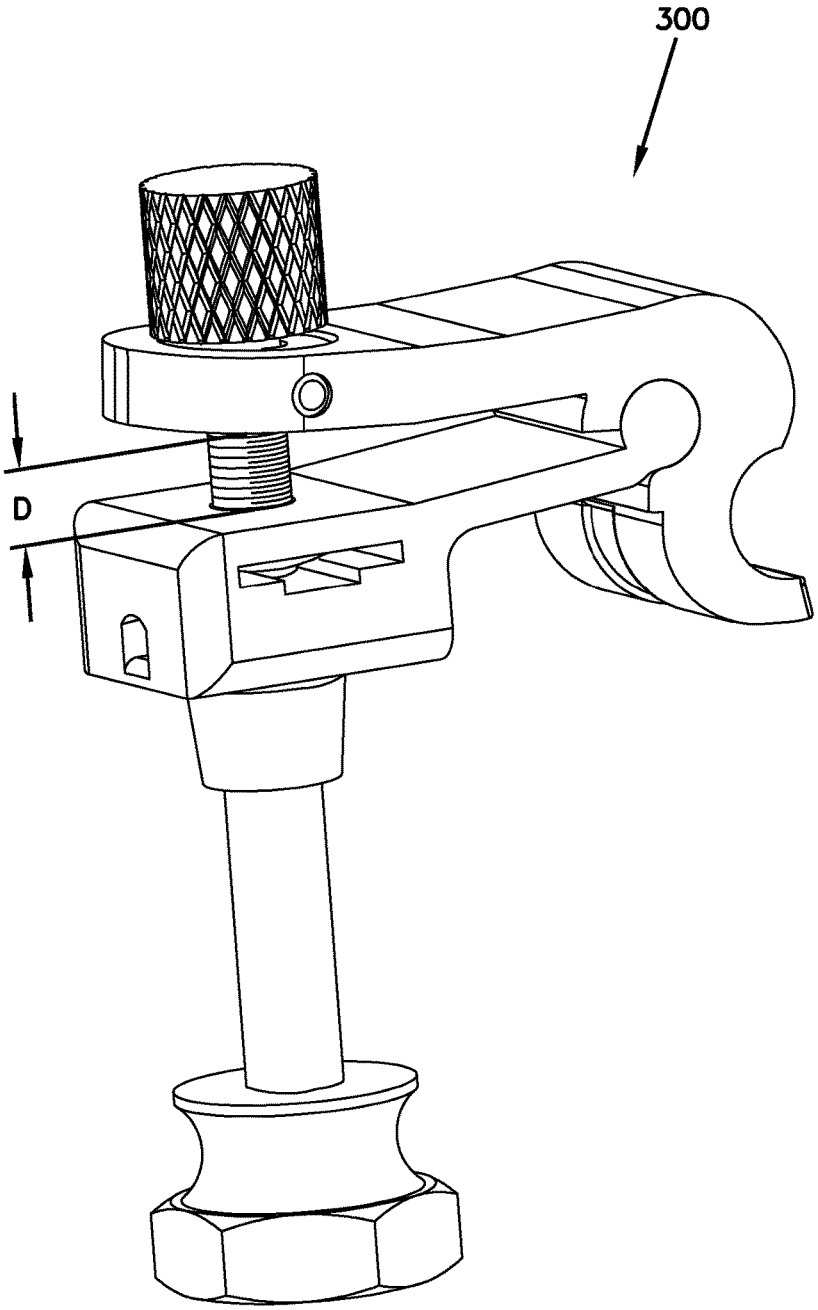
FIGS. 6A-6C show the string anchor of FIG. 4A in various operating positions.
Figure 6B:
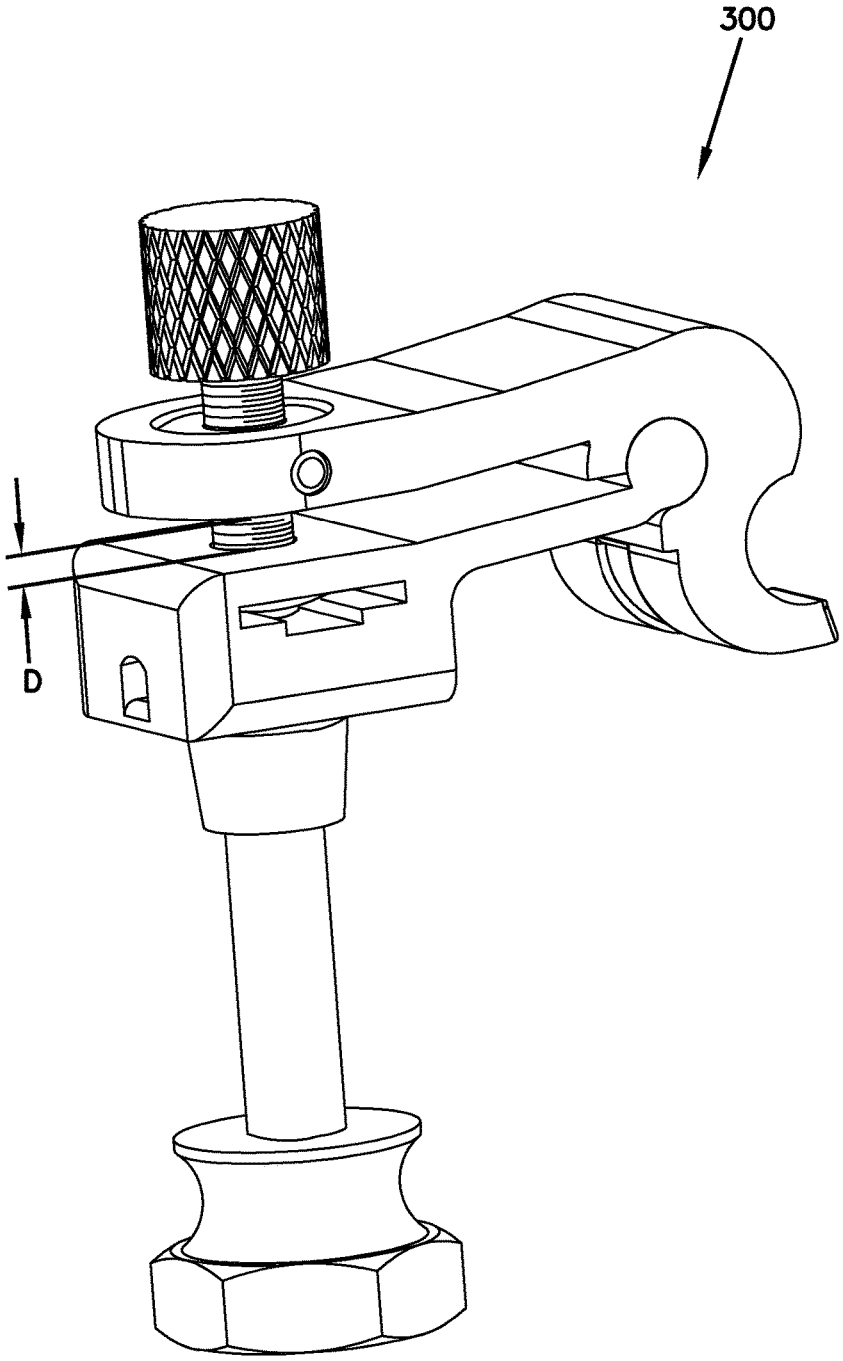
Figure 6C:
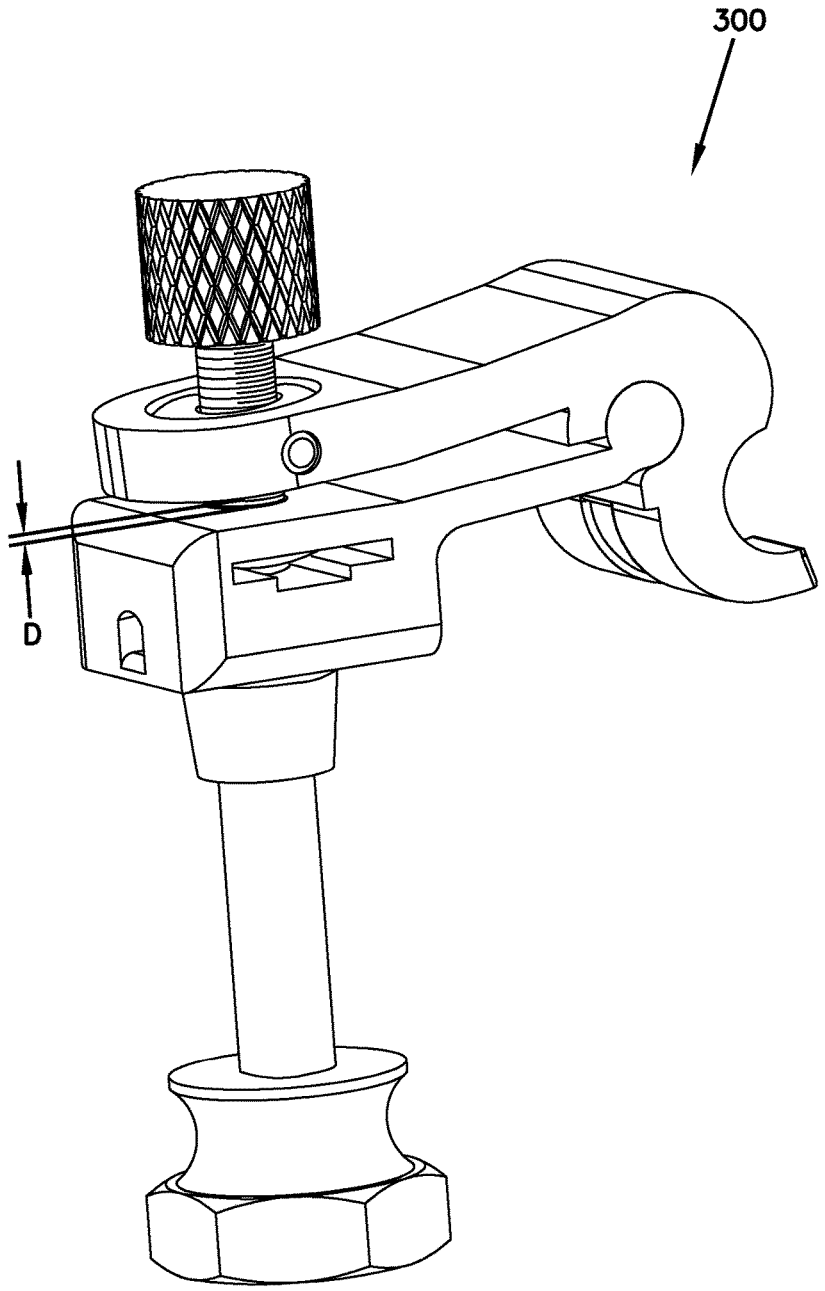

FIGS. 6A-6C show string anchor 300 in various ranges of pivoting. Distance D is the distance between an underside of string anchor seat arrangement 304 and a top surface of base arrangement 302. Rotating actuator arrangement 306 causes D to increase or decrease, depending upon the rotational direction, as a result of the pivoting motion of string anchor seat arrangement 304. As actuator arrangement 306 rotates and string anchor seat arrangement pivots, actuator arrangement 306 does not move vertically.

As D decreases, string tension increases. FIG. 6A shows distance D near a maximum value. Distance D decreases in each of FIGS. 6B and 6C. Distance D in FIG. 6C is near a minimum value.

Figure 7A:
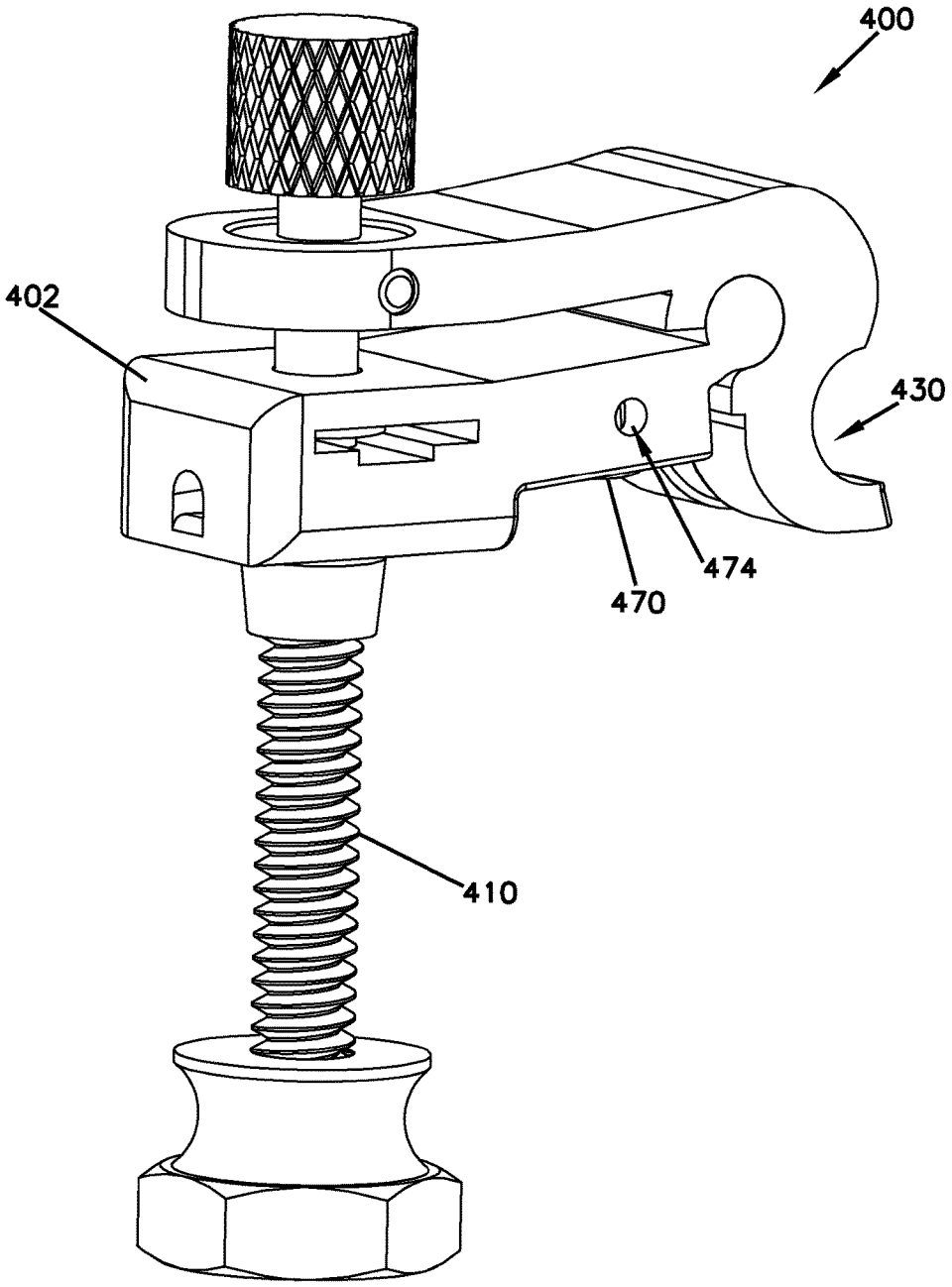
FIG. 7A is a front perspective view of a string anchor.

FIG. 7A is a front perspective view of string anchor 400. String anchor 400 includes all components and functionality of string anchor 300 described above but additionally includes piezo assembly 470.

Traditional acoustic guitar piezoelectric transducer pick-ups (known as "piezo pick-ups") are mounted below or within the bridge. These traditional piezo pickups combine the vibration of all six guitar strings into one electronic signal. The instantly-described configurations enable the control of volume, tone, frequency-dependent processing of audio signals (equalization), and/or effect and amplification of each individual guitar string. This can provide the guitar player with increased flexibility in customizing the sound of the guitar.

Figure 7B:
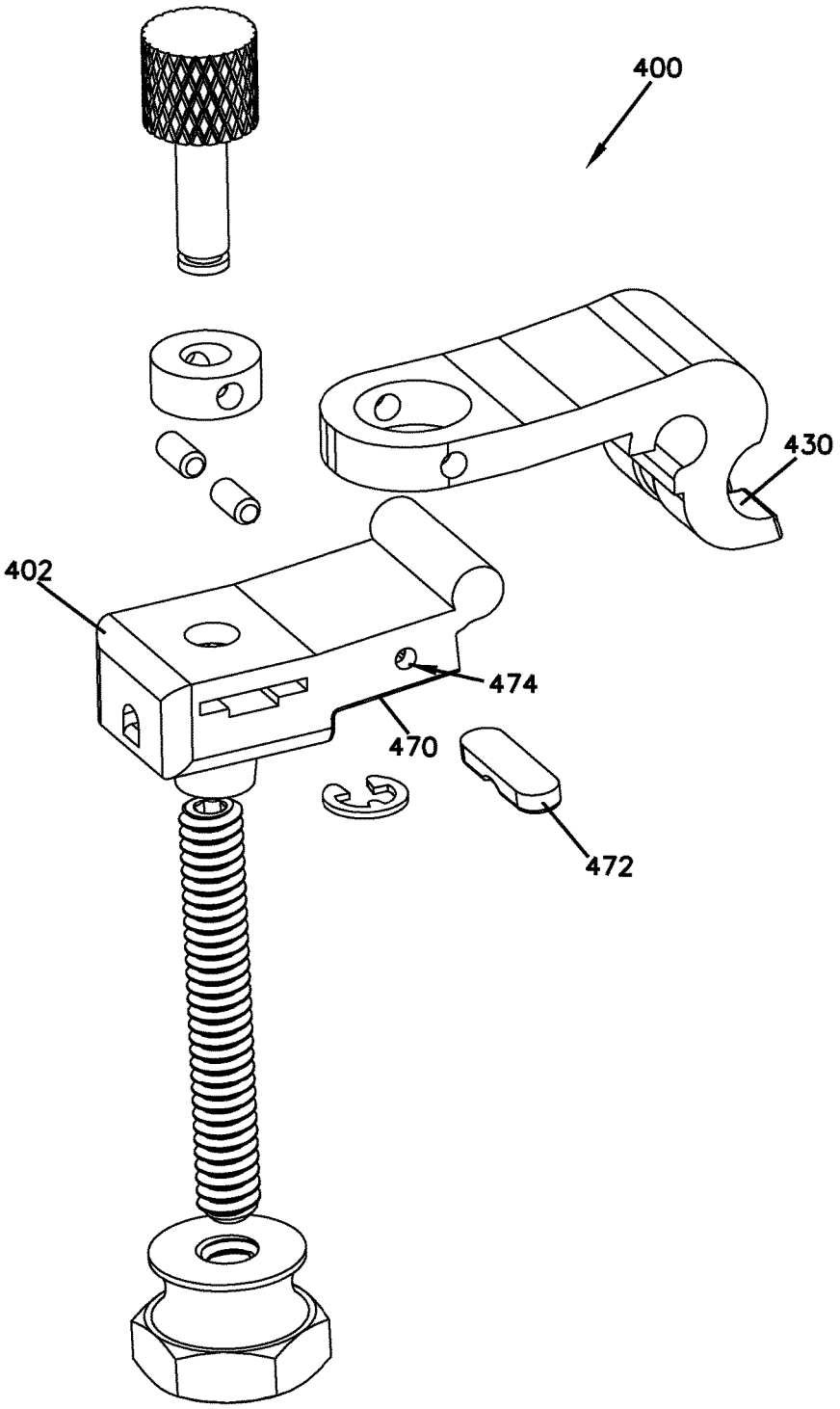
FIG. 7B is an exploded view of the string anchor of FIG. 7A.
Figure 7C:
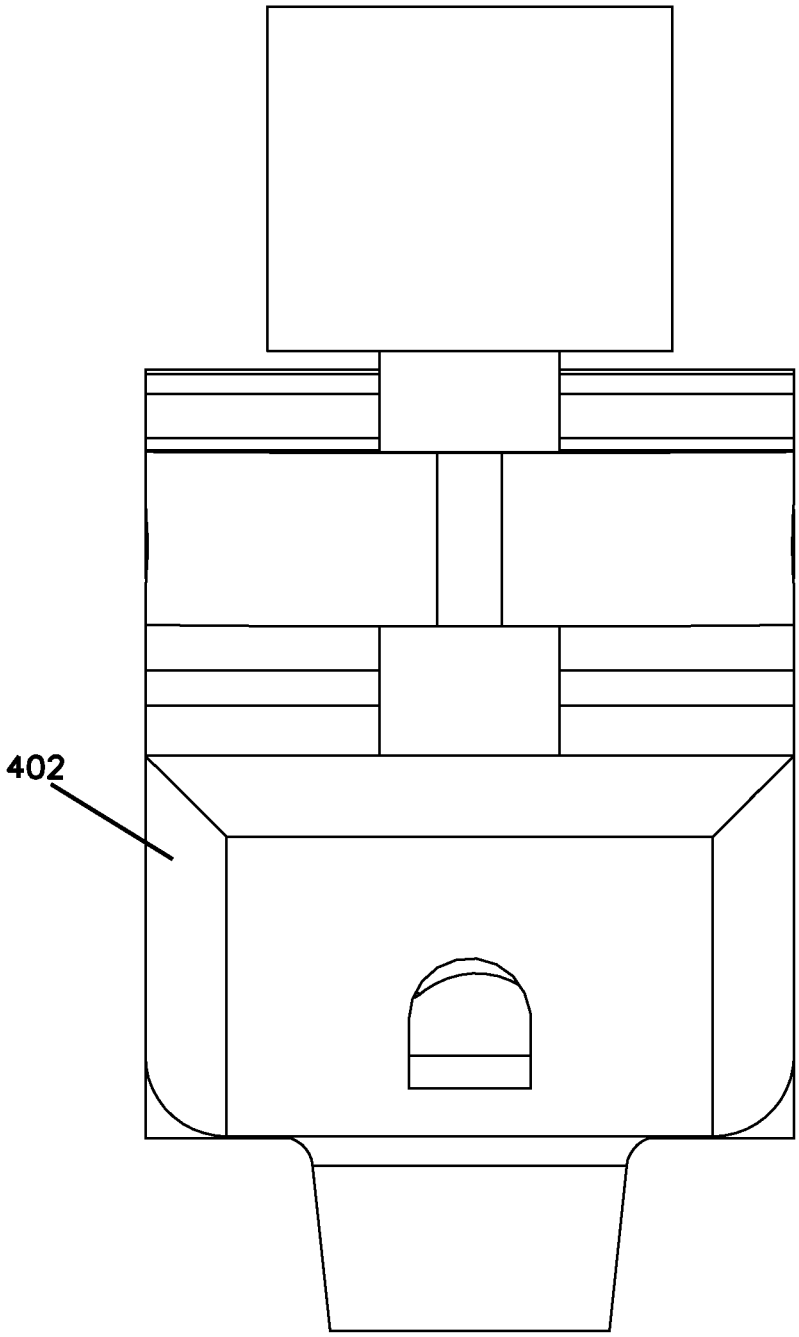
FIG. 7C is a front plan view of a portion of the string anchor of FIG. 7A.
Figure 7D:
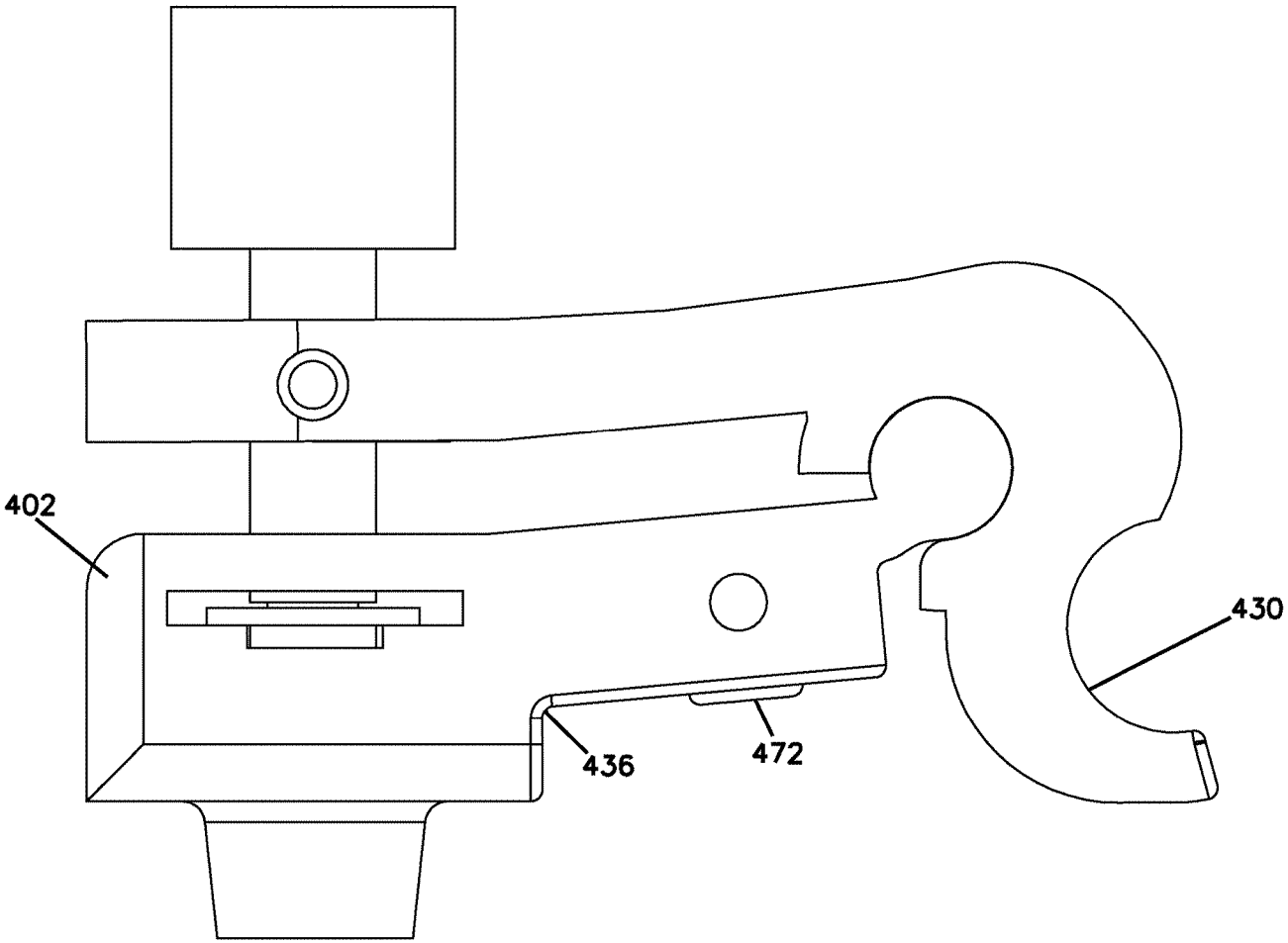
FIG. 7D is a right side plan view of the portion of string anchor shown in FIG. 7C.
Figure 7E:
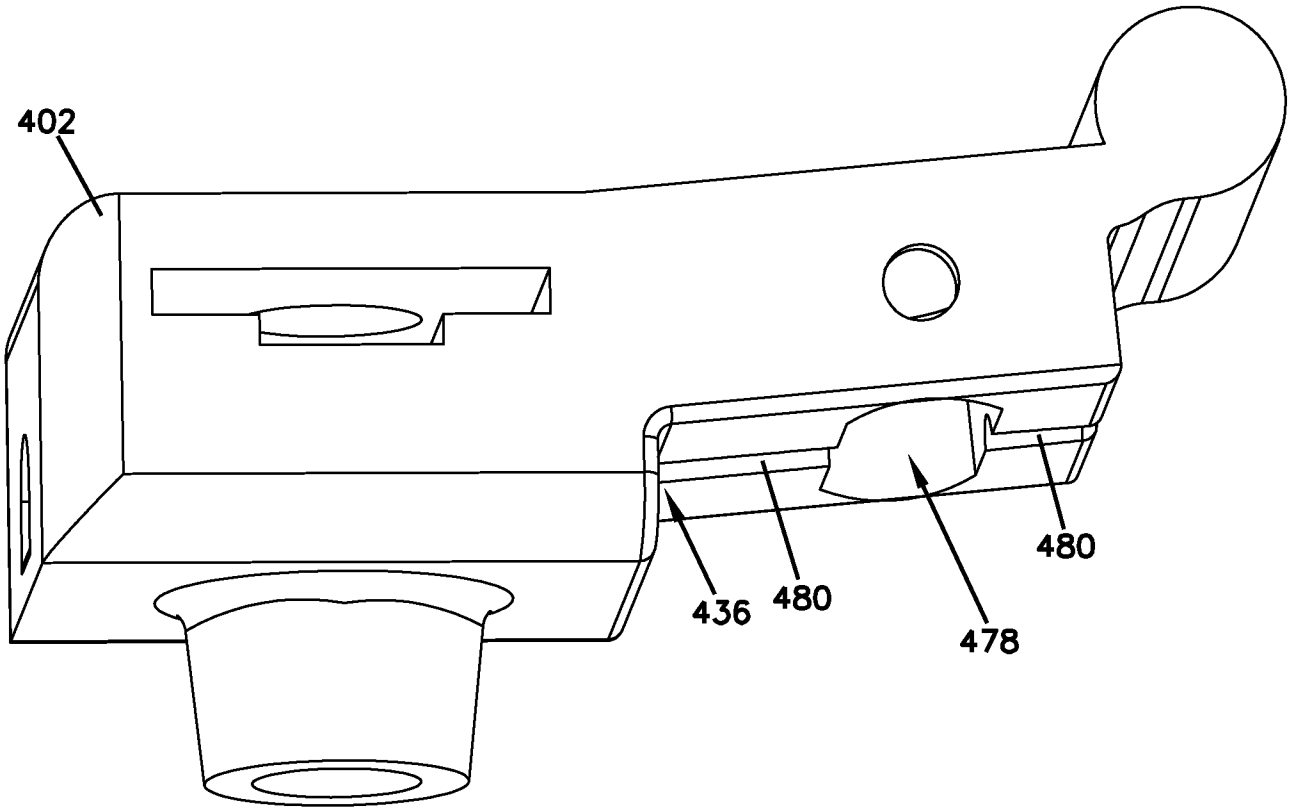
FIG. 7E is a bottom perspective view of the portion of string anchor shown in FIG. 7C.
Figure 7F:
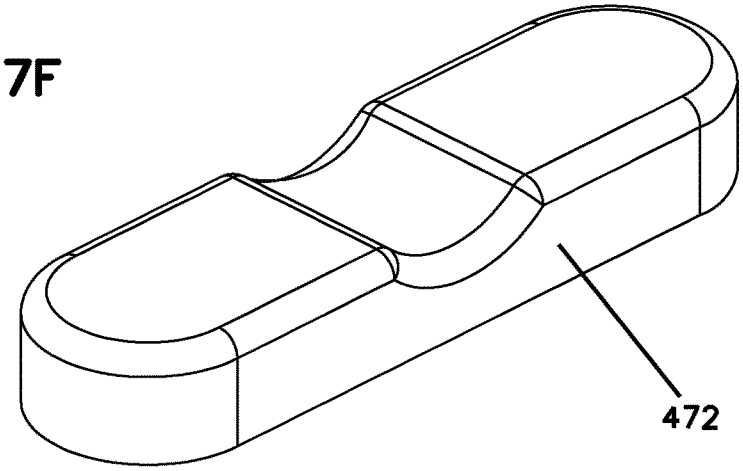
FIG. 7F is a perspective view of components of the string anchor of FIG. 7A.
Figure 7F:
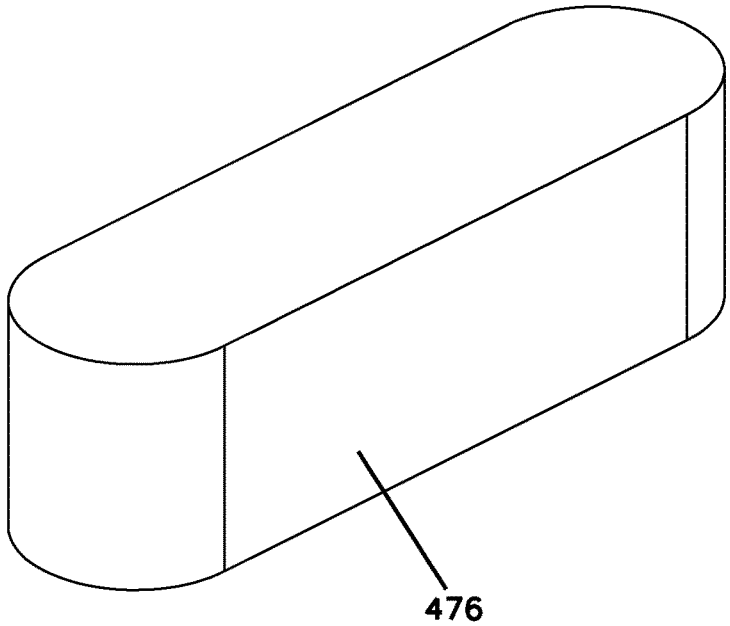

FIG. 7B is an exploded view of string anchor 400. FIG. 7C is a front plan view of string anchor 400 without securing peg 410. FIG. 7D is a right side view of string anchor 400 shown in FIG. 7C. FIG. 7E is a bottom perspective view of string anchor 400 shown in FIG. 7C. FIG. 7F shows components of piezo assembly 470 with the piezo element removed. Each of FIGS. 7A-7F are discussed concurrently below.

Piezo assembly 470 has piezoelectric transducer 472 that can be in communication with a receiver. Examples of receiver include amplifier, sound effect board, or other electronic processing device.

Communication between piezoelectric transducer 472 and receiver occurs via a wired or wireless connection. In the instance shown in FIGS. 7A-7F, wire (not shown) leads from piezoelectric transducer 472 and passes through wire window 474, where it is routed through string instrument body to receiver.

In some instances, the electric wire connects to a wireless signal transmitter or electronic jack mounted in the stringed instrument body. The electric wire can pass through the bridge of the stringed instrument. An electronic signal passes from the piezoelectric transducer 472 through the jack or wireless signal transmitter to a control unit which can enable adjustment of volume, tone or frequency-dependent processing of the audio signals from each of the guitar strings. This control unit can also provide pre-amplification of the guitar's sound. The control unit can, in turn, be in communication with a sound amplifier.

In some instances, piezoelectric transducer 472 enables an instrument player to tune the instrument via a tuner mounted on the body of the stringed instrument. The tuner is in electronic communication with the piezoelectric transducer 472.

Piezo assembly 470 includes piezoelectric transducer 472, window 474, foam 476, piezo cavity 478, and groove 480. Both piezo transducer 472 and foam 476 are positioned within piezo cavity. Piezo transducer 472 is positioned on the exterior so that it can be in contact with string passing from seat 430 to entry 436.

Piezoelectric transducer 472 is metal with a groove in the center. The groove provides a seat for string to sit in and vibrate against as the string is played. Abutting piezoelectric transducer 472 is foam 476. Foam 476 supports piezoelectric transducer 472 and provides a medium through which vibrations received by piezoelectric transducer are communicated to wire. Wire, not shown, makes an electrical connection with foam 476 within piezo cavity 478.

Figure 8:
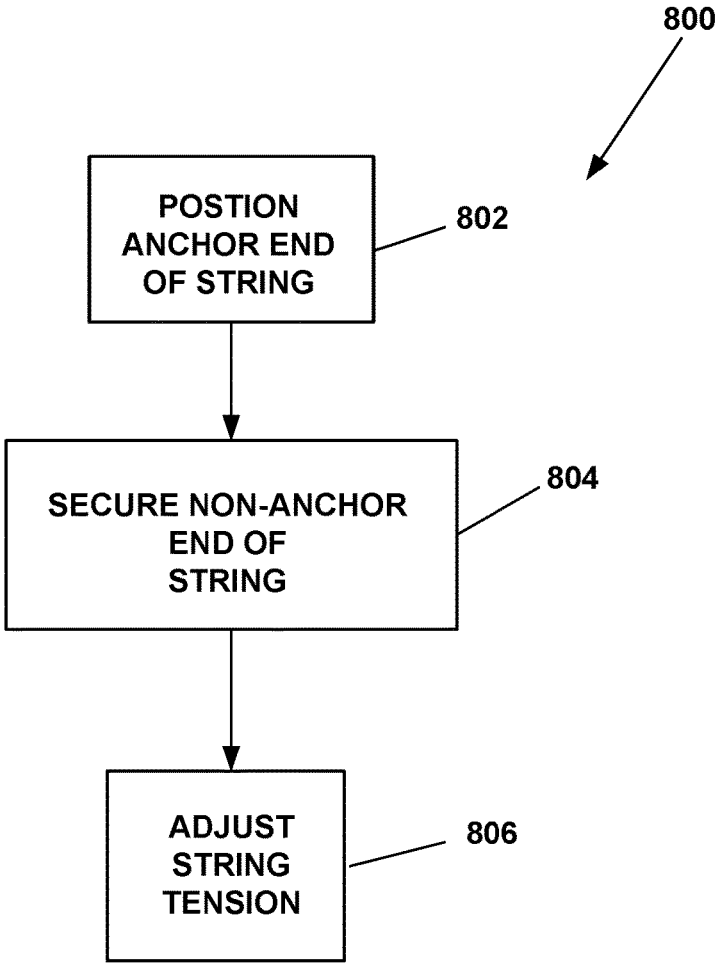
FIG. 8 is a schematic flow diagram indicating steps in a method of stringing a stringed instrument.

FIG. 8 shows an example method 800 for stringing an acoustic instrument. The instance of example method 800 shown includes positioning an anchor end of string (operation 802), securing a non-anchor end of string (operation 804), and adjusting string tension (operation 806). The example method is performed using string anchor 300 and/or string anchor 400 and described below accordingly. Other instances can include more or fewer operations.

The method 800 begins by positioning the anchor end of string (operation 802). First, the non-anchor end of string is fed through a notch in a tensioning arm and into an entry of channel in a string anchor body. As the non-anchor end of string emerges from an exit of channel in string anchor body, the string can be pulled through until little to no slack remains in the string between the anchor end and the string anchor.

Next, the string is passed over saddle on the bridge of the acoustic instrument. The non-anchor end is then secured (operation 804) to the mechanical tuning peg on a headstock of the acoustic instrument.

In some instances, the mechanical tuning peg is used to adjust string tension to a first tension (operation 806). Thereafter, a position actuator can be used to adjust the string tension further.

When string anchor 400 is used, method 800 can additionally include tuning the string using a tuner in communication with the piezoelectric element in string anchor 400. Additionally, or alternatively, method 800 can include adjusting the sound output of each string on stringed instrument having a string anchor with a piezoelectric element.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible.

While various embodiments have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. A string anchor arrangement adjustable for mounting and tensioning a string of a stringed instrument, the string anchor arrangement comprising:

a base arrangement including a string instrument mount, the base arrangement defining a string channel extending therethrough;

a tensioning arm pivotally mounted on the base arrangement, the tensioning arm defining a string anchor seat; and a rotatable threaded actuator arrangement positioned to adjust the location of the string anchor seat relative to the base arrangement when the threaded actuator arrangement is operated, whereby relative motion between the string anchor seat and the base arrangement adjusts string tension.

2. The string anchor arrangement according to claim 1, further comprising:

a link arrangement allowing for adjustable positioning of the tensioning arm relative to the base arrangement during rotation of the threaded actuator arrangement, the link arrangement mounted on an aperture through the tensioning arm, the link arrangement including a threaded pivot nut and pin, the pivot nut in communication with the threaded actuator arrangement.

3. The string anchor arrangement according to claim 2, the string channel having a string channel central axis and defining a surface sloping towards the string instrument mount.

4. The string anchor arrangement according to claim 3, wherein the string channel has an entry and an exit, the entry being relatively closer to the string anchor seat than the exit, whereby, the exit is lower than a height of a saddle when the string anchor arrangement is mounted to the stringed instrument.

5. The string anchor arrangement according to claim 3, wherein the tensioning arm defines a notch and wherein the string channel central axis passes through the notch.

6. The string anchor arrangement according to claim 5, wherein the string anchor seat defines a portion of the notch.

7. The string anchor arrangement according to claim 6, wherein the string anchor seat defines a concave surface.

8. The string anchor arrangement according to claim 1, wherein the threaded actuator arrangement maintains a constant vertical position relative to the base arrangement irrespective of a position of the tensioning arm.

9. The string anchor arrangement according to claim 1, further comprising a threaded actuator arrangement retainer in contact with the threaded actuator arrangement and disposed within the base arrangement; and wherein a portion of the threaded actuator arrangement is disposed within the base arrangement.

10. The string anchor arrangement according to claim 1, further comprising a piezoelectric transducer element supported by the base arrangement and positioned to be in contact with string supported by the string anchor arrangement.

11. The string anchor arrangement according to claim 10, wherein the piezoelectric transducer element defines a piezo notch and contacting a portion of the string in the piezo notch.

12. The string anchor arrangement according to claim 11, wherein the base arrangement further defines a piezo assembly aperture and a notch extending from the piezo assembly aperture towards the string anchor seat and towards a string channel extending through the base arrangement.

13. A stringed instrument including a string anchor arrangement, comprising:

a base arrangement including a mount near an end of the base arrangement, the base arrangement defining a string channel having a central axis, the base arrangement configured to be secured to the stringed instrument;

a string anchor seat arrangement configured to couple to the base arrangement at the mount and configured to receive an anchor end of guitar string;

a threaded actuator arrangement adjuster operatively coupled to the base arrangement and the string anchor seat arrangement; and a link arrangement in communication with the string anchor seat arrangement and the threaded actuator arrangement, the link arrangement communicating rotational motion from the threaded actuator arrangement to the string anchor seat arrangement.

14. The stringed instrument according to claim 13, wherein the string anchor seat arrangement further defines a notch at an end of the string anchor seat arrangement, the central axis passing through the notch; and the string channel having an upper surface, an entry and an exit, the upper surface at the entry relatively further from the mount than the upper surface at the exit.

15. The stringed instrument according to claim 14, wherein the threaded actuator arrangement maintains a constant vertical position relative to the base arrangement irrespective of a position of the string anchor seat arrangement;

the string anchor seat arrangement further comprising a string anchor seat defining a portion of the notch; and the string anchor seat defining a concave surface.

16. The stringed instrument according to claim 15, further comprising a piezoelectric transducer element supported by the base arrangement and positioned to be in contact with a string supported by the string anchor arrangement.

17. The stringed instrument according to claim 16, wherein the piezoelectric transducer element defines a piezo notch and contacting a portion of the string in the piezo notch; and further comprising a threaded actuator arrangement retainer in contact with the threaded actuator arrangement and disposed within the base arrangement; and wherein a portion of the threaded actuator arrangement is disposed within the base arrangement.

18. The stringed instrument according to claim 17, wherein a slope of the upper surface is at least 1° and no greater than 7°; and wherein a lower surface of the string channel has a slope no greater than 1°.

19. A method of stringing a string on an acoustic instrument, comprising:

positioning an anchor end of the string in a seat of a string anchor assembly, the string anchor assembly secured to the acoustic instrument, including:

passing a non-anchor end of the string into an entry of a channel defined by the string anchor assembly;

securing the non-anchor end of the string to a tuning peg at a headstock of the acoustic instrument;

adjusting tension of the string using a threaded actuator arrangement causing a pivoting of the seat.

20. The method according to claim 19, further comprising:

adjusting a sound of the string using an electronic device in communication with a piezoelectric transducer positioned on the string anchor assembly.

* * * * *